US005692291A

United States Patent [19]

Deevi et al.

[11] Patent Number: 5,692,291

[45] Date of Patent: Dec. 2, 1997

[54] METHOD OF MANUFACTURING AN ELECTRICAL HEATER

[75] Inventors: Seetharama C. Deevi, Midlothian; Patrick H. Hayes, Chester; Bernard C. Laroy, Richmond; Donald E. Miser; William H. Stevens, both of Midlothian, all of Va.

[73] Assignee: Philip Morris Incorporated, New York, N.Y.

[21] Appl. No.: 450,840

[22] Filed: May 25, 1995

Related U.S. Application Data

[62] Division of Ser. No. 380,718, Jan. 30, 1995, Pat. No. 5,666,978, and a division of Ser. No. 118,665, Sep. 10, 1993, Pat. No. 5,388,594, and a continuation-in-part of Ser. No. 943,504, Sep. 11, 1992, Pat. No. 5,505,214.

[51] Int. Cl.[6] ..... H05B 3/00; H05B 3/10; H01C 1/01

[52] U.S. Cl. ..... 29/611; 219/537; 219/539; 219/552; 338/260; 338/319; 338/320

[58] Field of Search ..... 29/611; 219/537, 219/539, 543, 552, 553; 338/203, 260, 319, 320

[56] References Cited

U.S. PATENT DOCUMENTS

| | | | |
|---|---|---|---|
| 1,771,366 | 7/1930 | Wyss et al. . | |
| 1,968,509 | 7/1934 | Tiffany . | |
| 2,057,353 | 10/1936 | Whittemore . | |
| 2,104,266 | 1/1938 | McCormick . | |
| 2,129,046 | 9/1938 | Clay | 338/319 |
| 2,442,004 | 5/1948 | Hayward-Butt . | |
| 2,456,144 | 12/1948 | Osterheld | 219/553 |
| 2,974,669 | 3/1961 | Ellis . | |
| 3,200,819 | 8/1965 | Gilbert . | |
| 3,248,682 | 4/1966 | Curtis | 219/543 |
| 3,255,760 | 6/1966 | Selke . | |
| 3,363,633 | 1/1968 | Weber . | |
| 3,402,723 | 9/1968 | Hu . | |
| 3,482,580 | 12/1969 | Hollabaugh . | |
| 3,608,560 | 9/1971 | Briskin et al. . | |
| 3,738,374 | 6/1973 | Bennett . | |
| 3,744,496 | 7/1973 | McCarty et al. . | |
| 3,804,100 | 4/1974 | Fariello . | |
| 3,889,690 | 6/1975 | Guarnieri . | |
| 4,016,061 | 4/1977 | Wasa et al. . | |
| 4,068,672 | 1/1978 | Guerra . | |
| 4,077,784 | 3/1978 | Vayrynen . | |

(List continued on next page.)

FOREIGN PATENT DOCUMENTS

| | | | |
|---|---|---|---|
| 1202378 | 3/1986 | Canada . | |
| 87/104459 | 2/1988 | China . | |
| 0 438 862 | 7/1982 | European Pat. Off. . | |
| 0 295 122 | 12/1988 | European Pat. Off. . | |
| 0 358 002 | 3/1990 | European Pat. Off. . | |
| 0 358 114 | 3/1990 | European Pat. Off. . | |
| 0 430 566 | 6/1991 | European Pat. Off. . | |
| 36 40 917 | 8/1988 | Germany . | |
| 37 35 704 | 5/1989 | Germany . | |
| 61-68061 | 4/1986 | Japan . | |
| 3-67483 | 3/1991 | Japan | 219/553 |
| 3-138886 | 6/1991 | Japan | 219/553 |
| 3-208284 | 9/1991 | Japan | 219/543 |
| 2 132 539 | 7/1984 | United Kingdom . | |
| 2 148 079 | 5/1985 | United Kingdom . | |
| 2 148 676 | 5/1985 | United Kingdom . | |
| 86/02528 | 5/1986 | WIPO . | |

*Primary Examiner*—P. W. Echols
*Attorney, Agent, or Firm*—Charles E. B. Glenn; James E. Schardt; James T. Moore

[57] ABSTRACT

A smoking system is provided in which a replaceable cigarette containing tobacco flavor material is electrically heated by a set of electrical heater elements contained within a lighter to evolve tobacco flavors or other components in vapor or aerosol form for delivery to a smoker. The cigarette and lighter are adapted to provide air flow patterns through the smoking system such that air flows transversely into the cigarette. Such patterns improve aerosol and flavor delivery to the smoker and reduce the condensation of residual heater-region vapor/aerosol in the smoking system.

14 Claims, 15 Drawing Sheets

U.S. PATENT DOCUMENTS

| | | |
|---|---|---|
| 4,131,119 | 12/1978 | Blasutti . |
| 4,141,369 | 2/1979 | Burruss . |
| 4,164,230 | 8/1979 | Pearlman . |
| 4,193,411 | 3/1980 | Faris et al. . |
| 4,215,708 | 8/1980 | Bron . |
| 4,219,032 | 8/1980 | Tabatnik et al. . |
| 4,246,913 | 1/1981 | Ogden et al. . |
| 4,256,945 | 3/1981 | Carter et al. . |
| 4,259,970 | 4/1981 | Green, Jr. . |
| 4,303,083 | 12/1981 | Burruss, Jr. . |
| 4,319,591 | 3/1982 | Keith et al. . |
| 4,393,884 | 7/1983 | Jacobs . |
| 4,431,903 | 2/1984 | Riccio . |
| 4,436,100 | 3/1984 | Green, Jr. . |
| 4,463,247 | 7/1984 | Lawrence et al. . |
| 4,505,282 | 3/1985 | Cogbill et al. . |
| 4,562,337 | 12/1985 | Lawrence . |
| 4,570,646 | 2/1986 | Herron . |
| 4,580,583 | 4/1986 | Green, Jr. . |
| 4,621,649 | 11/1986 | Osterrath . |
| 4,623,401 | 11/1986 | Derbyshire et al. . |
| 4,637,407 | 1/1987 | Bonanno et al. . |
| 4,659,912 | 4/1987 | Derbyshire . |
| 4,735,217 | 4/1988 | Gerth et al. . |
| 4,771,796 | 9/1988 | Myer . |
| 4,776,353 | 10/1988 | Lilja et al. . |
| 4,837,421 | 6/1989 | Luthy . |
| 4,846,199 | 7/1989 | Rose . |
| 4,848,376 | 7/1989 | Lilja et al. . |
| 4,874,924 | 10/1989 | Yamamoto et al. . |
| 4,877,989 | 10/1989 | Drews . |
| 4,922,901 | 5/1990 | Brooks et al. . |
| 4,945,931 | 8/1990 | Gori . |
| 4,947,874 | 8/1990 | Brooks et al. . |
| 4,947,875 | 8/1990 | Brooks et al. . |
| 4,966,171 | 10/1990 | Serrano et al. . |
| 4,981,522 | 1/1991 | Nichols et al. . |
| 4,991,606 | 2/1991 | Serrano et al. . |
| 4,998,541 | 3/1991 | Perfetti et al. . |
| 5,016,656 | 5/1991 | McMurtrie . |
| 5,034,721 | 7/1991 | Benedictus ..... 219/552 |
| 5,040,552 | 8/1991 | Nystrom et al. . |
| 5,042,510 | 8/1991 | Curtiss et al. . |
| 5,060,671 | 10/1991 | Counts et al. . |
| 5,076,296 | 12/1991 | Schleich et al. . |
| 5,093,894 | 3/1992 | Deevi et al. . |
| 5,095,921 | 3/1992 | Losee et al. . |
| 5,144,962 | 9/1992 | Counts et al. . |
| 5,159,940 | 11/1992 | Hayward et al. . |
| 5,179,966 | 1/1993 | Losee et al. . |
| 5,235,157 | 8/1993 | Blackburn . |
| 5,249,586 | 10/1993 | Morgan et al. . |
| 5,269,327 | 12/1993 | Counts et al. . |
| 5,274,214 | 12/1993 | Blackburn . |
| 5,285,050 | 2/1994 | Blackburn . |

Fig. 1
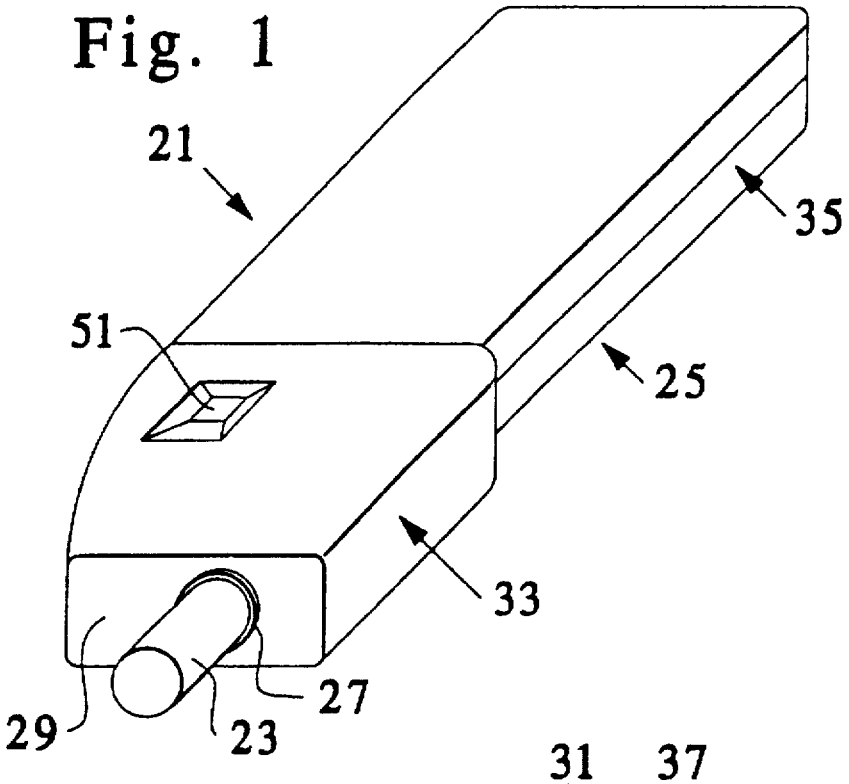
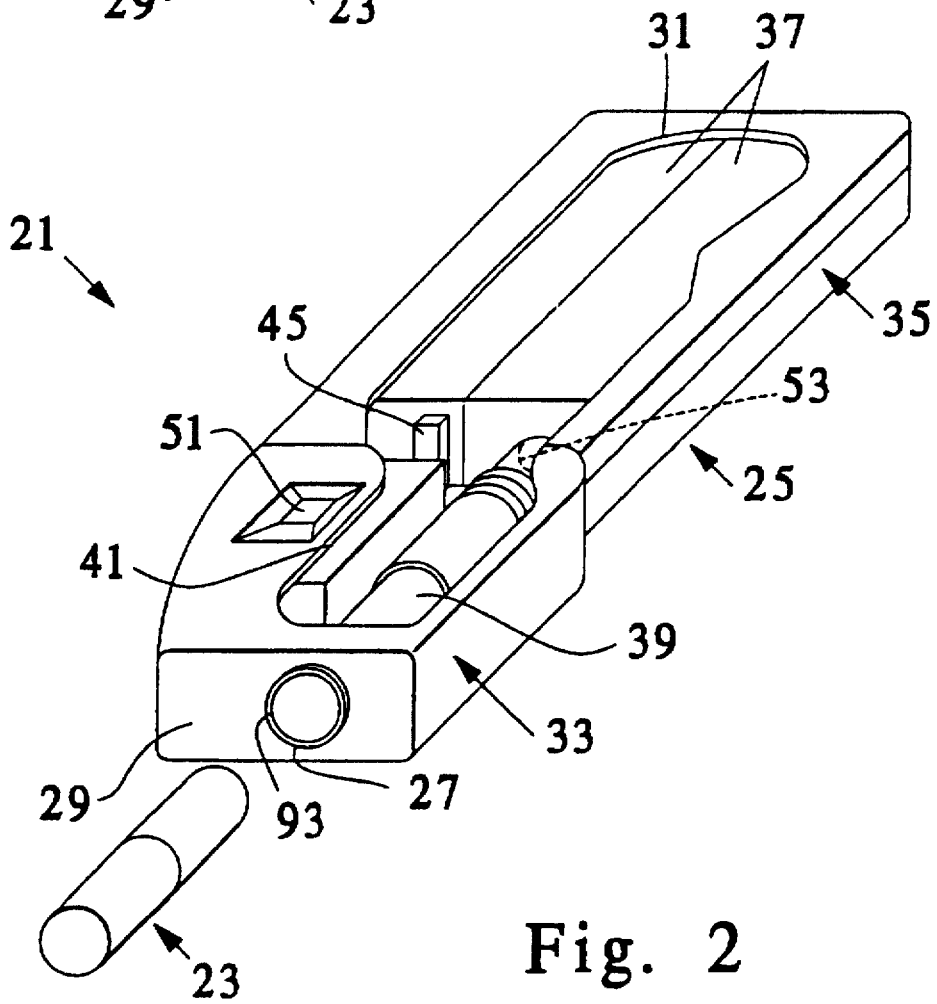
Fig. 2

177A
93A
83A
173A
89
85
159
99
91
89
43
95
39A
171A
163A
87A
49A
81A
97A
109
111
161A
161A
55A
47A
105A

Fig. 12A
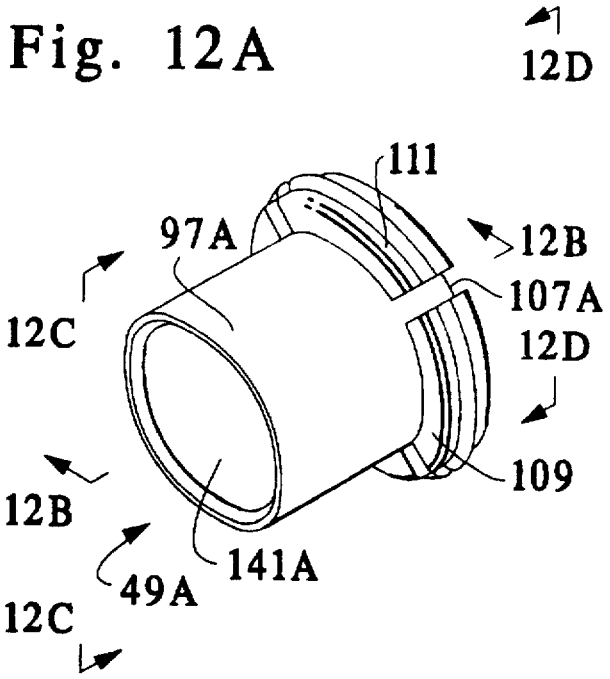
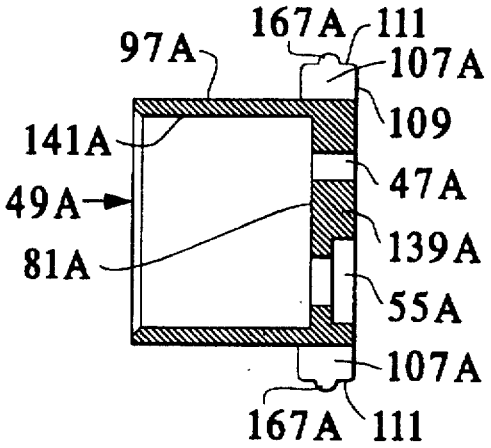
Fig. 12B
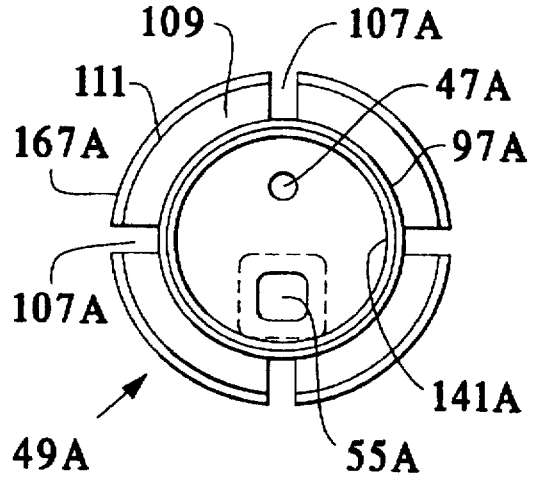
Fig. 12C
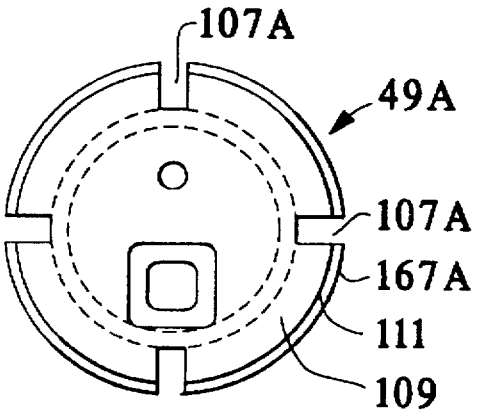
Fig. 12D

Fig.14A
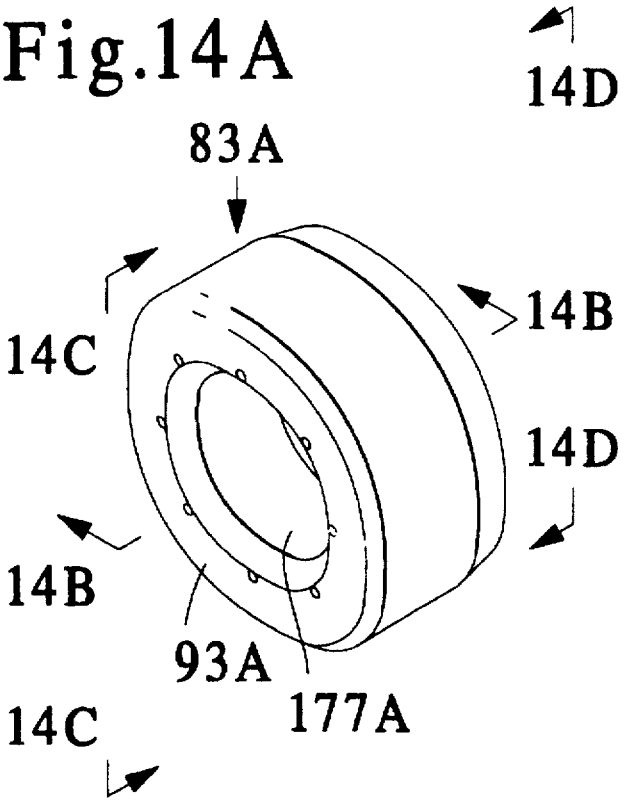
Fig.14B
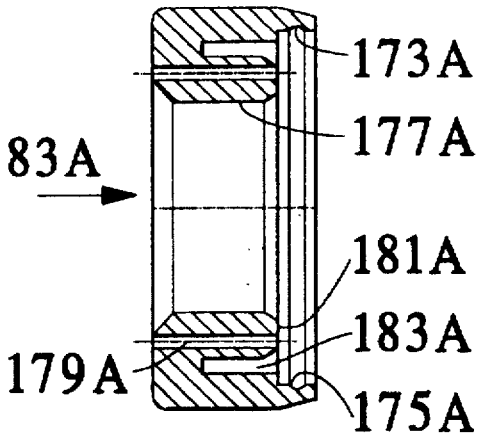
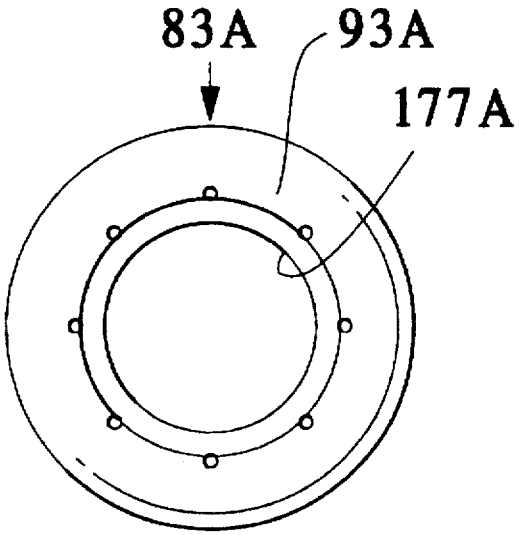
Fig.14C
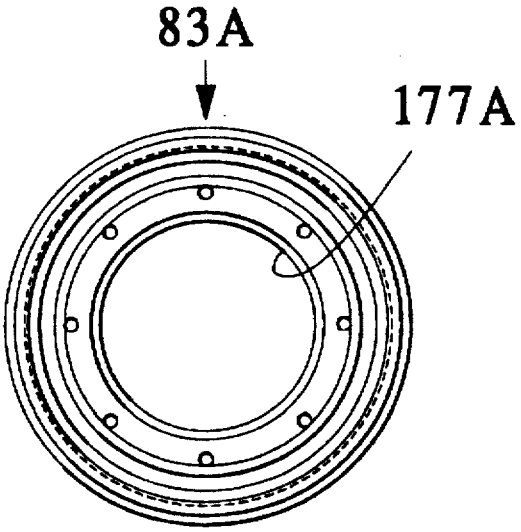
Fig.14D

METHOD OF MANUFACTURING AN ELECTRICAL HEATER

CROSS REFERENCE TO RELATED APPLICATION

This application is a divisional of U.S. patent application Ser. No. 08/380,718, filed Jan. 30, 1995, now U.S. Pat. No. 5,621,189 and Ser. No. 08/118,665, filed Sep. 10, 1993, which issued as U.S. Pat. No. 5,388,594 on Feb. 14, 1995, and being a continuation-in-part of commonly-assigned U.S. patent application Ser. No. 07/943,504, filed Sep. 11, 1992 now U.S. Pat. No. 5,505,214.

BACKGROUND OF THE INVENTION

This invention relates to smoking systems in which cigarettes are used with lighters, and methods for making the same.

An electrical smoking article is described in commonly-assigned U.S. Pat. No. 5,060,671, which is hereby incorporated by reference in its entirety. That patent describes a smoking article which is provided with a disposable set of electrical heating elements. A charge of tobacco flavor medium containing, for example, tobacco or tobacco-derived material is deposited on each of the heating elements. The disposable heater/flavor unit is mated to a source of electrical energy such as a battery or capacitor, as well as to control circuitry to actuate the heating elements in response to a puff by a smoker on the article or in response to the depression of a manual switch. The circuitry is designed so that at least one, but less than all of the heating elements are actuated for any one puff, and so that a predetermined number of puffs, each containing a pre-measured amount of tobacco flavor substance, e.g., an aerosol containing tobacco flavors or a flavored tobacco response, is delivered to the smoker. The circuitry also preferably prevents the actuation of any particular heater more than once, to prevent overheating of the tobacco flavor medium thereon.

With such articles, the heater is thrown away with the spent remainder of tobacco material. Also, the electrical connections between the heaters and the battery must be able to endure repeated release and reconnection as flavor units are replaced.

In copending, commonly-assigned U.S. patent application Ser. No. 07/666,926, filed Mar. 11, 1991, now abandoned in favor of Continuing application Ser. No. 08/012,799, filed Feb. 2, 1993, an electrical smoking article is disclosed that has reusable heating elements and a disposable portion for tobacco flavor generation. The disposable portion preferably includes a flavor segment and a filter segment, attached by a tipping paper or other fastening arrangement. Certain operational difficulties are, however, associated with reusable heating elements, particularly in that residual aerosol tends to settle and condense on the heating elements and other permanent structural components of the article.

U.S. patent application Ser. No. 07/943,504, filed Sep. 11, 1992, which is hereby incorporated by reference in its entirety, describes another electrical smoking article that has reusable heating elements and a disposable portion for tobacco flavor generation. That application addresses problems relating to the long-term use of heating elements and other permanent structural components of the article. That application also describes a manufacturing process for making the disposable portion of the smoking article using conventional high-volume assembly machinery. More specifically, that application describes a disposable tobacco flavor unit having a "tube-in-tube" construction, wherein tobacco flavor material positioned on a carrier and formed into a cylinder around free-flow, back-flow, and mouthpiece filters is disposed within an aerosol barrier tube. Heater elements are placed between the aerosol barrier tube and the tobacco flavor unit to heat the tobacco flavor unit. The aerosol barrier tube prevents aerosols formed during heating of the tobacco flavor unit and the heaters from condensing on permanent portions of the electrical smoking article. That application also describes the use of phosphorous doped silicon heater elements having the ability to cycle to temperatures of between 200° C. and 900° C. and deliver between 5 and 40 Joules of energy repeatedly without failure.

In light of the above, it is therefore desirable to be able to provide an improved smoking system in which the heating elements of the lighter are reusable.

It is also desirable to be able to provide such a system in which condensation of aerosol onto the heating elements and other structural components of the lighter is minimized.

It is further desirable to provide a smoking article which is easier to manufacture.

It is still further desirable to provide a smoking article which provides improved flavor delivery to the smoker.

SUMMARY OF THE INVENTION

Accordingly, a primary object of the present invention is to provide a novel smoking system which provides advantages over prior systems.

Another object of the present invention is to provide improved flavor delivery from a smoking system in which cigarettes are used with lighters.

It is also an object of this invention to provide a smoking system in which the heating elements of a lighter are reusable, and of which the volume of disposable portions is minimized.

It is also an object of this invention to provide a system in which condensation of aerosol onto heating elements and other structural components of a lighter is minimized.

It is a further object of this invention to provide a smoking article and manufacturing processes for making the same that are easier and cost effective, even at state-of-the-art mass production speeds.

It is a still further object of this invention to provide improved aerosol and flavor delivery to the smoker.

In accordance with one aspect of the present invention, a cigarette for use in a smoking system for delivering a flavored tobacco response to a smoker, the system including heating means, is provided. The cigarette includes a carrier having first and second ends spaced apart in a longitudinal direction and having first and second surfaces. The first surface defines a cavity between the first and second ends, and the second surface includes an area for being disposed adjacent heating means. Tobacco flavor material is disposed on the first surface of the carrier. The tobacco flavor material generates the flavored tobacco response in the cavity for delivery to a smoker when the tobacco flavor material is heated by the heating means. The carrier and the tobacco flavor material allow transverse air flow into the cavity.

In accordance with another aspect of the present invention, a lighter for use in combination with a removable cigarette in a smoking system that delivers a flavored tobacco response to a smoker is provided. The lighter includes a heater fixture for receiving, through a first end, a removable cigarette. The heater fixture has means for providing a transverse flow of air to at least a portion of the cigarette. A plurality of electrical heater elements are disposed in the heater fixture. Each of the heater elements has a surface for being disposed adjacent a surface of the portion of the cigarette to which the transverse flow of air is provided. Means are provided for activating one or more of the plurality of electrical heating means such that a predetermined quantity of flavored tobacco response is generated in the cigarette. The transverse flow of air is generated when a smoker draws on a cigarette inserted in the lighter.

In accordance with another aspect of the present invention, a smoking system for delivering a flavored tobacco response to a smoker is provided. The system includes a removable cigarette, a lighter, and, means for individually activating the plurality of electrical heating means such that a predetermined quantity of flavored tobacco response is generated in a cavity in the cigarette.

In accordance with yet another aspect of the present invention, a heater element for use in a smoking system for delivering a flavored tobacco response to a smoker is provided. The heater element includes a first end, a second end, and a plurality of curved regions between the first and second ends for increasing electrical resistance of the heater element. The heater element is formed from resistive material having first and second surfaces substantially oriented in a plane and having an overall length L, overall width W, and thickness T. The effective electrical length of the heater element is greater than the length L and the effective electrical cross-sectional area of the heater element is less than the product of W and T.

In accordance with still another aspect of the present invention, a method for manufacturing an integrated heater assembly for use in a smoking system for delivering a flavored tobacco response to a smoker is described. According to the method, a sheet of resistive material is cut to form a plurality of heater elements connected to one another at at least one end. The sheet is formed into a cylindrical shape.

BRIEF DESCRIPTION OF THE DRAWINGS

The present invention can be further understood with reference to the following description in conjunction with the appended drawings, wherein the same elements are provided with the same reference numerals. In the drawings:

FIG. 1 is a schematic perspective view of a smoking system according to an embodiment of the present invention;

FIG. 2 is a partially broken, schematic perspective view of a smoking system according to an embodiment of the present invention;

FIG. 12A is a schematic, perspective view of a combined spacer base member according to an embodiment of the present invention;

FIG. 12B is a schematic, side cross-sectional view taken at section 12B—12B of FIG. 12A;

FIG. 12C is a schematic view taken at section 12C—12C of FIG. 12A;

FIG. 12D is a schematic view taken at section 12D—12D of FIG. 12A;

FIG. 14A is a schematic, perspective view of a cap according to an embodiment of the present invention;

FIG. 14B is a schematic, side cross-sectional view taken at section 14B—14B of FIG. 12A;

FIG. 14C is a schematic view taken at section 14C—14C of FIG. 14A;

FIG. 14D is a schematic view taken at section 14D—14D of FIG. 14A;

DETAILED DESCRIPTION

Figure 3A:
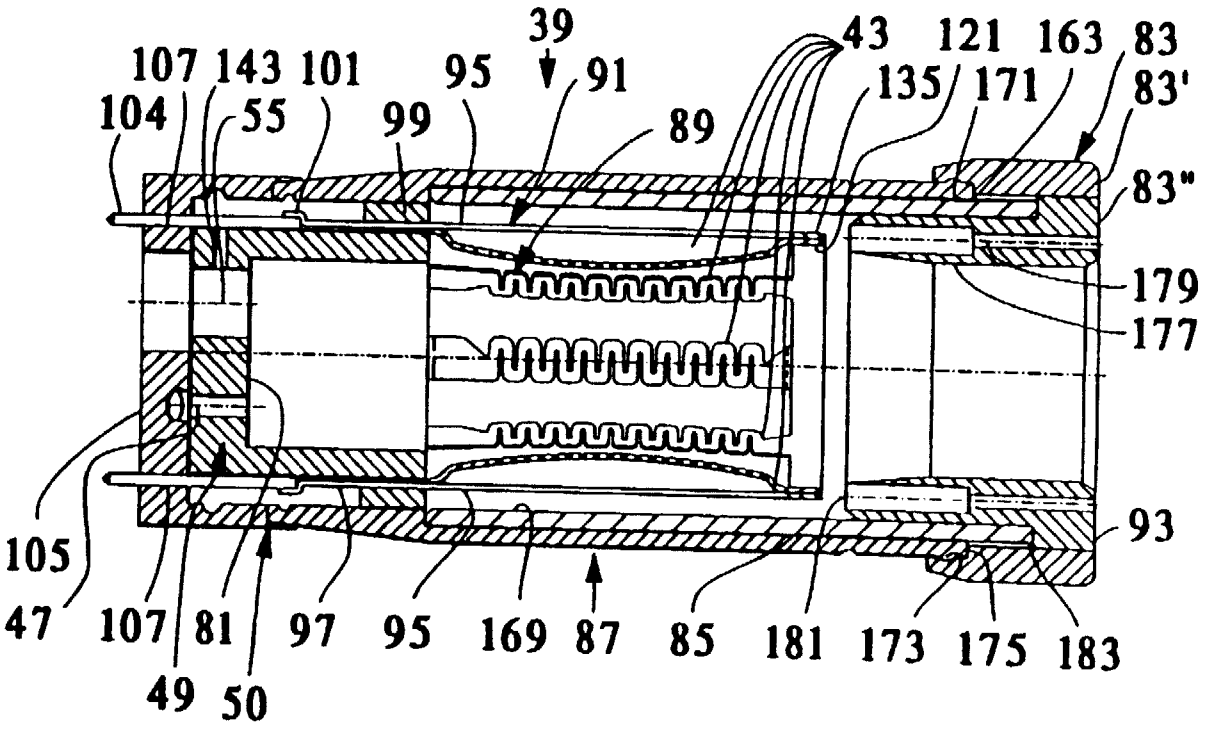
FIG. 3A is a side, cross-sectional view of a heater fixture according to an embodiment of the present invention.

A smoking system 21 according to the present invention is seen with reference to FIGS. 1 and 2. The smoking system 21 includes a cigarette 23 and a reusable lighter 25. The cigarette 23 is adapted to be inserted in and removed from an orifice 27 at a front end 29 of the lighter 25. The smoking system 21 is used in much the same fashion as a conventional cigarette. The cigarette 23 is disposed of after one or more puff cycles. The lighter 25 is preferably disposed of after a greater number of puff cycles as the cigarette 23.

The lighter 25 includes a housing 31 and has front and rear portions 33 and 35. A power source 37 for supplying energy to heating elements for heating the cigarette 23 is preferably disposed in the rear portion 35 of the lighter 25. The rear portion 35 is preferably adapted to be easily opened and closed, such as with screws or with snap-fit components, to facilitate replacement of the power source 37. The front portion 33 preferably houses heating elements and circuitry in electrical communication with the power source 37 in the rear portion 35. The front portion 33 is preferably easily joined to the rear portion 35, such as with a dovetail joint or by a socket fit. The housing 31 is preferably made from a hard, heat-resistant material. Preferred materials include metal-based or, more preferably, polymer-based materials. The housing 31 is preferably adapted to fit comfortably in the hand of a smoker and, in a presently preferred embodiment, has overall dimensions of 10.7 cm by 3.8 cm by 1.5 cm.

The power source 37 is sized to provide sufficient power for heating elements that heat the cigarette 23. The power source 37 is preferably replaceable and rechargeable and may include devices such as a capacitor or, more preferably, a battery. In a presently preferred embodiment, the power source is a replaceable, rechargeable battery (actually four nickel cadmium battery cells connected in series) with a total, non-loaded voltage of approximately 4.8 to 5.6 volts. The characteristics required of the power source 37 are, however, selected in view of the characteristics of other components in the smoking system 21, particularly the characteristics of the heating elements. U.S. Pat. No. 5,144,962 describes several forms of power sources useful in connection with the smoking system of the present invention, such as rechargeable battery power sources and quick-discharging capacitor power sources that are charged by batteries, and is hereby incorporated by reference.

A substantially cylindrical heating fixture 39 for heating the cigarette 23, and, preferably, for holding the cigarette in place relative to the lighter 25, and electrical control circuitry 41 for delivering a predetermined amount of energy from the power source 37 to heating elements (not seen in FIGS. 1 and 2) of the heating fixture are preferably disposed in the front 33 of the lighter. In the presently preferred embodiment, the heating fixture 39 includes eight radially spaced heating elements 43, seen in FIG. 3A, that are individually energized by the power source 37 under the control of the circuitry 41 to heat eight areas around the periphery of the cigarette 23 to develop eight puffs of a flavored tobacco response. While other numbers of heating elements 43 may be provided, eight heater elements are preferred, at least because there are nominally eight puffs on a conventional cigarette and because eight heater elements lend themselves to electrical control with binary devices.

The circuitry 41 is preferably activated by a puff-actuated sensor 45, seen in FIG. 2, that is sensitive either to pressure changes or air flow changes that occur when a smoker draws on the cigarette 23. The puff-actuated sensor 45 is preferably disposed in the front 33 of the lighter 25 and communicates with a space inside the heater fixture 39 and near the cigarette 23 through a passageway 47 extending through a spacer 49 and a base 50 of the heater fixture and, if desired, a puff sensor tube (not shown). A puff-actuated sensor 45 suitable for use in the smoking system 21 is described in U.S. Pat. No. 5,060,671, the disclosure of which is incorporated by reference, and is in the form of a Model 163PC01D35 silicon sensor, manufactured by the MicroSwitch division of Honeywell, Inc., Freeport, Ill., which activates an appropriate one of the heater elements 43 as a result of a change in pressure when a smoker draws on the cigarette 23. Flow sensing devices, such as those using hot-wire anemometry principles, have also been successfully demonstrated to be useful for activating an appropriate one of the heater elements 43 upon detection of a change in air flow.

An indicator 51 is preferably provided on the exterior of the lighter 25, preferably on the front 33, to indicate the number of puffs remaining on a cigarette 23 inserted in the lighter. The indicator 51 preferably includes a seven-segment liquid crystal display. In the presently preferred embodiment, the indicator 51 displays the digit "8" when a light beam emitted by a light sensor 53, seen in FIG. 2, is reflected off of the front of a newly inserted cigarette 23 and detected by the light sensor. The light sensor 53 is preferably mounted in an opening 55 in the spacer 49 and the base 50 of the heater fixture 39, seen, for example, in FIG. 3A. The light sensor 53 provides a signal to the circuitry 41 which, in turn, provides a signal to the indicator 51. The display of the digit "8" on the indicator 51 reflects that the preferred eight puffs provided on each cigarette 23 are available, i.e., none of the heater elements 43 have been activated to heat the new cigarette. After the cigarette 23 is fully smoked, the indicator displays the digit "0". When the cigarette 23 is removed from the lighter 25, the light sensor 53 does not detect the presence of a cigarette 23 and the indicator 51 is turned off. The light sensor 53 is modulated so that it does not constantly emit a light beam and provide an unnecessary drain on the power source 37. A presently preferred light sensor 53 suitable for use with the smoking system 21 is a Type OPR5005 Light Sensor, manufactured by OPTEK Technology, Inc., 1215 West Crosby Road, Carrollton, Tex. 75006.

As one of several possible alternatives to using the above-noted light sensor 53, a mechanical switch (not shown) may be provided to detect the presence or absence of a cigarette 23 and a reset button (not shown) may be provided for resetting the circuitry 41 when a new cigarette is inserted in the lighter 25, e.g., to cause the indicator 51 to display the digit "8", etc. Power sources, circuitry, puff-actuated sensors, and indicators useful with the smoking system 21 of the present invention are described in U.S. Pat. No. 5,060,671 and U.S. patent application Ser. No. 07/943,504, both of which are incorporated by reference. The passageway 47 and the opening 55 in the spacer 49 and the heater fixture base 50 are preferably air-tight during smoking.

Figure 4A:
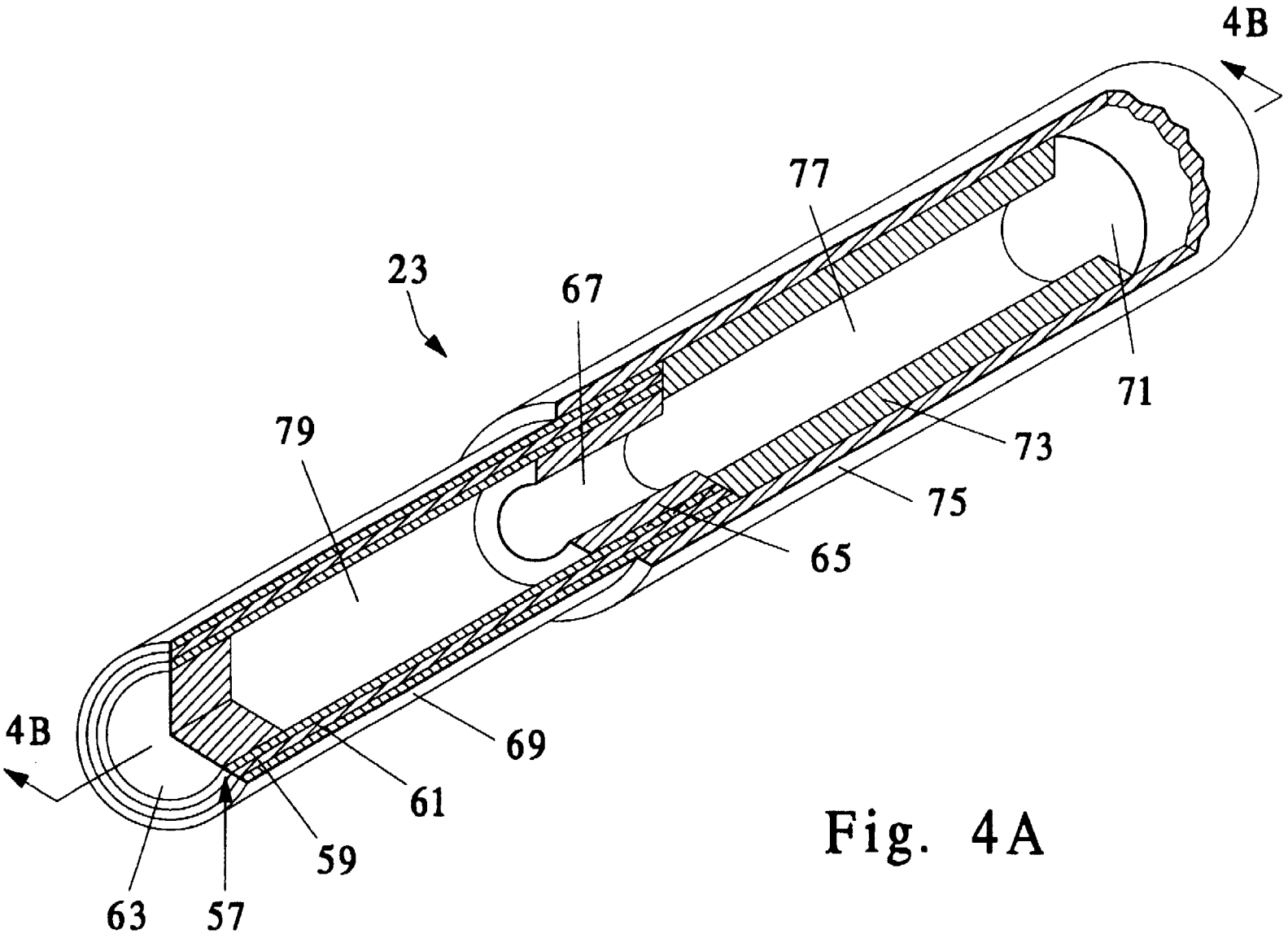
FIG. 4A is a schematic perspective view of a cigarette according to an embodiment of the present invention.
Figure 4B:
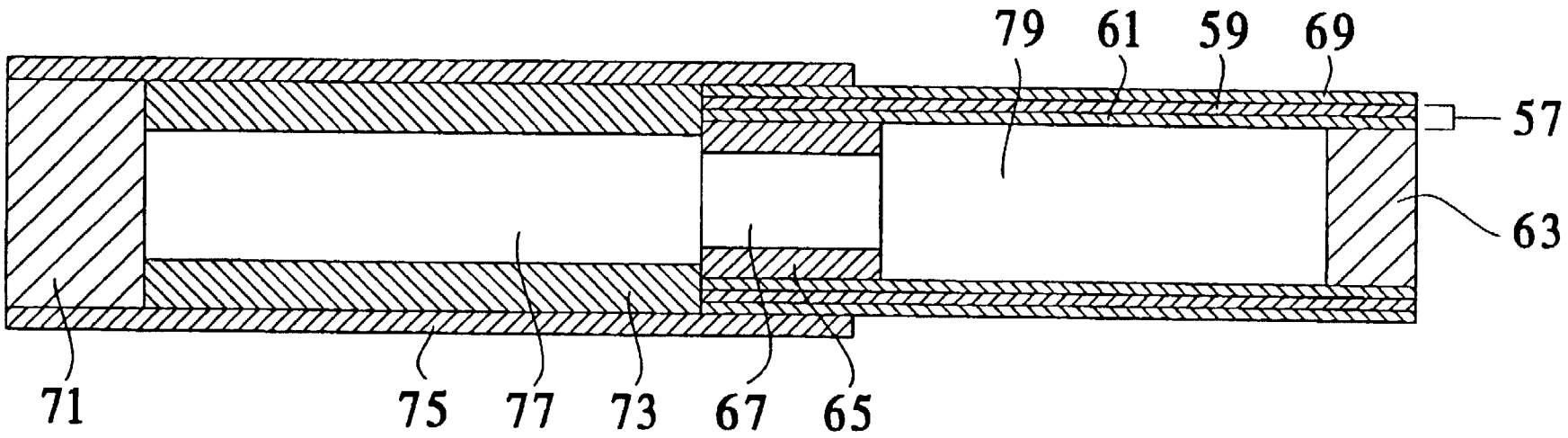
FIG. 4B is a side cross-sectional view taken at section 4B—4B of FIG. 4A.

A presently preferred cigarette 23 for use with the smoking system 21 is seen in detail in FIGS. 4A and 4B, although the cigarette may be in any desired form capable of generating a flavored tobacco response for delivery to a smoker when the cigarette is heated by the heating elements 43. The cigarette 23 includes a tobacco web 57 formed of a carrier or plenum 59 which supports tobacco flavor material 61, preferably including tobacco. The tobacco web 57 is wrapped around and supported by a cylindrical back-flow filter 63 at one end and a cylindrical first free-flow filter 65 at an opposite end. The first free-flow filter 65 is preferably an "open-tube" type filter having a longitudinal passage 67 extending through the center of the first free-flow filter and, hence, provides a low resistance to draw or free flow.

If desired, cigarette overwrap paper 69 is wrapped around the tobacco web 57. Types of paper useful as the overwrap paper 69 include a low basis weight paper, preferably a paper with a tobacco flavor coating, or a tobacco-based paper to enhance the tobacco flavor of a flavored tobacco response. A concentrated extract liquor in full or diluted strength may be coated on the overwrap paper 69. The overwrap paper 69 preferably possesses a minimal base weight and caliper while providing sufficient tensile strength for machine processes. Presently preferred characteristics of a tobacco-based paper include a basis weight (at 60% relative humidity) of between 20–25 grams/m$^2$, minimum permeability of 0–25 CORESTA (defined as the amount of air, measured in cubic centimeters, that passes through one square centimeter of material, e.g., a paper sheet, in one minute at a pressure drop of 1.0 kilopascal), tensile strength≧2000 grams/27 mm width (1 in/min), caliper 1.3–1.5 mils, $CaCO_3$ content≦5%, citrate 0%. Materials for forming the overwrap paper 69 preferably include≧75% tobacco-based sheet (non-cigar, flue- or flue-/air-cured mix filler and bright stem). Flax fiber in amounts no greater than that necessary to obtain adequate tensile strength may be added. The overwrap paper 69 can also be conventional flax fiber paper of basis weight 15–20 g/m$^2$ or such paper with an extract coating. Binder in the form of citrus pectin may be added in amounts less than or equal to 1%. Glycerin in amounts no greater than necessary to obtain paper stiffness similar to that of conventional cigarette paper may be added.

The cigarette 23 also preferably includes a cylindrical mouthpiece filter 71, which is preferably a conventional RTD-type (Resistance To Draw) filter, and a cylindrical second free-flow filter 73. The mouthpiece filter 71 and the second free-flow filter are secured to one another by tipping paper 75. The tipping paper 75 extends past an end of the second free-flow filter 73 and is attached to the overwrap paper 69 to secure an end of the first free-flow filter 65 in position adjacent an end of the second free-flow filter. Like the first free-flow filter 65, the second free-flow filter 73 is preferably formed with a longitudinal passage 77 extending through its center. The back-flow filter 63 and the first free-flow filter 65 define, with the tobacco web 57, a cavity 79 within the cigarette 23.

It is preferred that the inside diameter of the longitudinal passage 77 of the second free-flow filter 73 be larger than the inside diameter of the longitudinal passage 67 of the first free-flow filter 65. Presently preferred inside diameters for the longitudinal passage 67 are between 1–4 mm and for the longitudinal passage 77 are between 2–6 mm. It has been observed that the different inside diameters of the passages 67 and 77 facilitates development of a desirable mixing or turbulence between the aerosol developed from the heated tobacco flavor material and air drawn in from outside the cigarette 23 during drawing on the cigarette, resulting in an improved flavored tobacco response and facilitating exposure of more of an end of the mouthpiece filter 71 to the mixed aerosol. The flavored tobacco response developed by heating the tobacco flavor material 61 is understood to be primarily in a vapor phase in the cavity 79 and to turn into a visible aerosol upon mixing in the passage 77. In addition to the above-described first free-flow filter 65 having a longitudinal passage 67, other arrangements capable of generating the desired mixing of the vapor phase flavored tobacco response with introduced air include those in which a first free-flow filter is provided in the form of a filter having a multitude of small orifices, i.e., the first free-flow filter may be in the form of a honeycomb or a metal plate having multiple holes formed therein.

Air is preferably drawn into the cigarette 23 predominantly through the tobacco web 57 and the ovewrap paper 69, in a transverse or radial path, and not through the back-flow filter 63 in a longitudinal path. As explained below, however, it is desirable to permit air flow through the back-flow filter during a first puff on the cigarette to lower the RTD. It is presently understood that drawing air into the cigarette 23 longitudinally tends to result in the aerosol developed by heating the tobacco web 57 with the heater elements 43 arranged radially around the tobacco web not being properly removed from the cavity 79. It is presently preferred to produce a flavored tobacco response as a function almost entirely of the makeup of the tobacco web 57 and the energy level of the heater elements 43. Accordingly, the portion of the air flow through the cigarette resulting from longitudinal flow through the back-flow filter 63 is preferably minimal during smoking, except during the first puff. Further, the back-flow filter 63 preferably minimizes the flow of aerosol in a backward direction out of the cavity 79 after heating of the tobacco flavor material 61, so that the potential for damage to components of the lighter 25 from aerosol flowing backward from the cigarette 23 is minimized.

The carrier or plenum 59 which supports the tobacco flavor material 61 provides a separation between the heating elements 43 and the flavor material, transfers heat generated by the heater elements to the flavor material, and maintains cohesion of the cigarette after smoking. Preferred carriers 59 include those composed of a non-woven carbon fiber mat, preferred because of its thermal stability. Such carriers are discussed in greater detail in U.S. patent application Ser. No. 07/943,504 and copending commonly-assigned U.S. patent application Ser. No. 07/943,747, filed Sep. 11, 1992, which are incorporated by reference.

Other carriers 59 include low mass, open mesh metallic screens or perforated metallic foils. For example, a screen having a mass in the range from about 5 g/m$^2$ to about 15 g/m$^2$ and having wire diameters in the range from about 0.038 mm (about 1.5 mils) to about 0.076 mm (about 3.0 mils) is used. Another embodiment of the screen is formed of a 0.0064 mm (about 0.25 mil)-thick foil (e.g., aluminum) having perforations with diameters in the range from about 0.3 mm to about 0.5 mm, to reduce the mass of the foil by about 30 percent to about 50 percent, respectively. Preferably, the perforation pattern of such a foil is staggered or discontinuous (i.e., not in straight arrangement) to reduce the lateral conduction of heat away from the tobacco flavor material 61.

Such metallic screens and foils are incorporated into a cigarette 23 in a variety of ways including, for example, (1) casting a tobacco flavor slurry on a belt and overlaying the screen or foil carrier on the wet slurry prior to drying, and (2) laminating the screen or foil carrier to a tobacco flavor base sheet or mat with a suitable adhesive. Because of the possibility of electrical shorting in or between the heater elements 43 where a metallic carrier is used, such carriers should generally not be in direct contact with the heating elements. Where a metallic carrier is used, suitable binders and low basis weight paper, such as the overwrap paper 69, are preferably used to provide electrical insulation between the metallic carrier 59 and the electrical heater elements 43.

A presently preferred tobacco web 57 is formed using a paper making-type process. In this process, tobacco strip is washed with water. The solubles are used in a later coating step. The remaining (extracted) tobacco fiber is used in the construction of a base mat. Carbon fibers are dispersed in water and sodium alginate is added. Any other hydrocolloid which does not interfere with the flavored tobacco response, is water soluble, and has a suitable molecular weight to impart strength to the tobacco web 57 may be added in lieu of the sodium alginate. The dispersion is mixed with the slurry of extracted tobacco fibers and optional flavors. The resultant mixture is wet-laid onto a fourdriner wire and the web is passed along the remainder of a traditional paper making machine to form a base web. The solubles removed by washing the tobacco strip are coated onto one side of the base web, preferably by a standard reverse roll coater located after a drum or Yankee dryer. The tobacco solubles/tobacco dust or particulate ratio is preferably varied between a 1:1 and a 20:1 ratio. The slurry may also be cast or extruded onto the base mat. Alternatively, the coating step is produced off-line. During or after the coating step, flavors that are conventional in the cigarette industry are added.

Pectin or another hydrocolloid is added, preferably in a range of between 0.1 to 2.0%, to improve the coatability of the slurry.

Whichever type of carrier 59 is used, tobacco flavor material 61 which is disposed on the inner surface of the carrier liberates flavors when heated and is able to adhere to the surface of the carrier. Such materials include continuous sheets, foams, gels, dried slurries, or dried spray-deposited slurries, which preferably, although not necessarily, contain tobacco or tobacco-derived materials, and which are more fully discussed in the above-incorporated U.S. patent application Ser. No. 07/943,747.

Preferably, a humectant, such as glycerin or propylene glycol, is added to the tobacco web 57 during processing in amounts equalling between 0.5% and 10% of humectant by the weight of the web. The humectant facilitates formation of a visible aerosol by acting as an aerosol precursor. When a smoker exhales an aerosol containing the flavored tobacco response and the humectant, the humectant condenses in the atmosphere, and the condensed humectant provides the appearance of conventional cigarette smoke.

The cigarette 23 is preferably a substantially constant diameter along its length and, like conventional cigarettes, is preferably between approximately 7.5 mm and 8.5 mm in diameter so that a smoker has a similar "mouth feel" with the smoking system 21 as with a conventional cigarette. In the presently preferred embodiment, the cigarette 23 is 58 mm in length, overall, thereby facilitating the use of conventional packaging machines in the packaging of such cigarettes. The combined length of the mouthpiece filter 71 and the second free-flow filter 73 is preferably 30 mm. The tipping paper 75 preferably extends 5 mm past the end of the second free-flow filter 73 and over the tobacco web 57. The length of the tobacco web 57 is preferably 28 mm. The tobacco web 57 is supported at opposite ends by the back-flow filter 63, which is preferably 7 mm in length, and the first free-flow filter 65, which is preferably 7 mm in length. The cavity 79 defined by the tobacco web 57, the back-flow filter 63, and the first free-flow filter 65 is preferably 14 mm in length.

When the cigarette 23 is inserted in the orifice 27 in the first end 29 of the lighter 25, it abuts or nearly abuts an inner bottom surface 81 of the spacer 49 of the heater fixture 39, seen in FIG. 3A, adjacent the passageway 47 communicating with the puff-actuated sensor 45 and the opening 55 for the light sensor 53. In this position, the cavity 79 of the cigarette 23 is preferably adjacent the heater elements 43 and substantially all of that portion of the cigarette including the second free-flow filter 73 and the mouthpiece filter 71 extends outside of the lighter 25. Portions of the heater elements 43 are preferably biased radially inward to facilitate holding the cigarette 23 in position relative to the lighter 25 and so that they are in a thermal transfer relationship with the tobacco web 57, either directly or through the overwrap paper 69. Accordingly, the cigarette 23 is preferably compressible to facilitate permitting the heater elements 43 to press into the sides of the cigarette.

Air flow through the cigarette 23 is accomplished in several ways. For example, in the embodiment of the cigarette 23 shown in FIGS. 4A and 4B, the overwrap paper 69 and the tobacco web 57 are sufficiently air permeable to obtain a desired RTD such that, when a smoker draws on the cigarette, air flows into the cavity 79 transversely or radially through the overwrap paper and the tobacco web. As noted above, an air-permeable back-flow filter 69 may be used to provide longitudinal air flow into the cavity 79.

If desired, transverse air flow into the cavity 79 is facilitated by providing a series of radial perforations (not shown) through the overwrap paper 69 and the tobacco web 57 in one or more regions adjacent the cavity. Such perforations have been observed to improve the flavored tobacco response and aerosol formation. Perforations having a density of approximately 1 hole per 1–2 square millimeters and a hole diameter of between 0.4 mm and 0.7 mm are provided through the tobacco web 57. This results in preferred CORESTA porosity of between 100–500. The overwrap paper 69, after perforation, preferably has a permeability of between 100 and 1000 CORESTA. Of course, to achieve desired smoking characteristics, such as resistance to draw, perforation densities and associated hole diameters other than those described above may be used.

Transverse air flow into the cavity 79 is also facilitated by providing perforations (not shown) through both the overwrap paper 69 and the tobacco web 57. In forming a cigarette 23 having such perforations, the overwrap paper 69 and the tobacco web 57 are attached to one another and then perforated together or are perforated separately and attached to one another such that the perforations in each align or overlap.

Figure 3B:
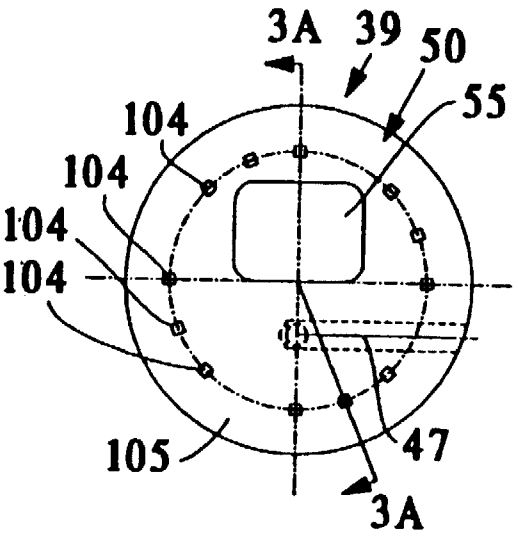
FIG. 3B is an end view of taken at section 3B—3B of FIG. 3A.

A presently preferred embodiment of the heater fixture 39 is seen with reference to FIGS. 3A–3B. An exploded view of a modified embodiment of a heater fixture 39A having a combined spacer and base member 49A is seen with reference to FIG. 5. The member 49A of the heater fixture 39A replaces the spacer 49 and base 50 of the heater fixture 39 shown in FIG. 3A. The general functions of providing a space for receiving a cigarette 23 and of providing heater elements for heating the cigarette may, of course, be accomplished with heater fixtures other than those shown in FIGS. 3A–3B and 5.

With reference to FIGS. 3A–3B, the heater fixture 39 is disposed in the orifice 27 in the lighter 25. The cigarette 23 is inserted, back-flow filter 63 first, in the orifice 27 in the lighter 25 into a substantially cylindrical space of the heater fixture 39 defined by a ring-shaped cap 83 having an open end for receiving the cigarette, an optional, cylindrical protective heater sleeve 85, a cylindrical air channel sleeve 87, a heater assembly 89 including the heater elements 43, an electrically conductive pin or common lead assembly 91, which serves as a common lead for the heater elements of the heater assembly, and the spacer 49. The bottom inner surface 81 of the spacer 49 stops the cigarette 23 in a desired position in the heater fixture 39 such that the heater elements 43 are disposed adjacent the cavity 79 in the cigarette. In the heater fixture 39A shown in FIG. 5, the bottom inner surface 81A of the member 49A stops the cigarette 23 in the desired position in the heater fixture.

Substantially all of the heater fixture 39 is disposed inside and secured in position by a snug fit with the housing 31 of the front 33 of the lighter 25. A forward edge 93 of the cap 83 is preferably disposed at or extending slightly outside the first end 29 of the lighter 25 and preferably includes an internally beveled or rounded portion to facilitate guiding the cigarette 23 into the heater fixture 39. Portions of the heater elements 43 of the heater assembly 89 and pins 95 of the pin assembly 91 are secured around an exterior surface 97 of the spacer 49 in a friction fit by a ring 99. Rear ends 101 of the heater elements 43 and rear ends 103 of, preferably, two of the pins 95 are preferably welded to pins 104 securely fitted in and extending past a bottom outer surface 105, seen in FIG. 3B, of the base 50 through holes 107 in the base for connection to the circuitry 41 and the power source 37. The pins 104 are preferably sufficiently well attached to the base 50 so that they block air flow through the holes 107. The pins 104 are preferably received in corresponding sockets (not shown), thereby providing support for the heater fixture 39 in the lighter 25, and conductors or printed circuits lead from the socket to the various electrical elements. The other two pins 95 provide additional support to strengthen the pin assembly 91. The passageway 47 in the spacer 49 and the base 50 communicates with the puff-actuated sensor 45 and the light sensor 53 senses the presence or absence of a cigarette 23 in the lighter 25.

Figure 5:
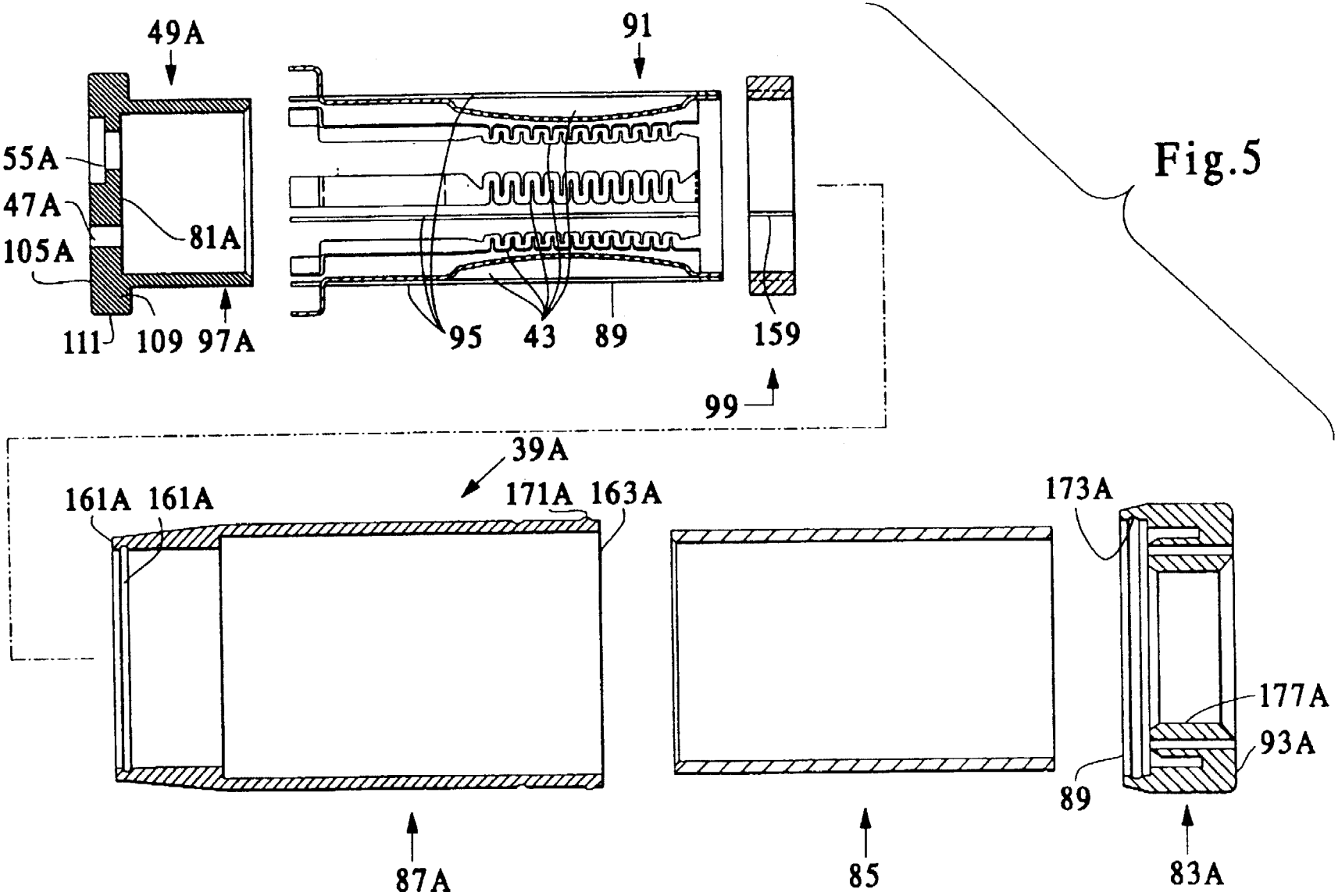
FIG. 5 is a schematic assembly view of a heater fixture according to another embodiment of the present invention.

Similarly, in the heater fixture 39A shown in FIG. 5, portions of the heater elements 43 of the heater assembly 89 and pins 95 of the pin assembly 91 are secured around an exterior surface 97A of the member 49A in a friction fit by a ring 99. Rear ends 101 of the heater elements 43 and rear ends 103 of preferably two of the pins 95 extend past a bottom outer surface 105A of the member 49A for connection to the circuitry 41 and the power source 37.

The member 49A is preferably formed with a flanged end 109 in which at least two grooves or holes 107A are formed and through which the rear ends 103 of two of the pins 95 extend past the bottom outer surface 105A. The other two pins 95 provide additional strength to the pin assembly 91. The rear ends 101 of the heater elements 43 are bent to conform to the shape of the flanged end 109 and extend past the bottom outer surface 105A radially outside of an outer edge 111 of the flanged end. The passageway 47 in the member 49A communicates with the puff-actuated sensor 45 and the light sensor 53 senses the presence or absence of a cigarette 23 in the lighter 25.

Figure 6:
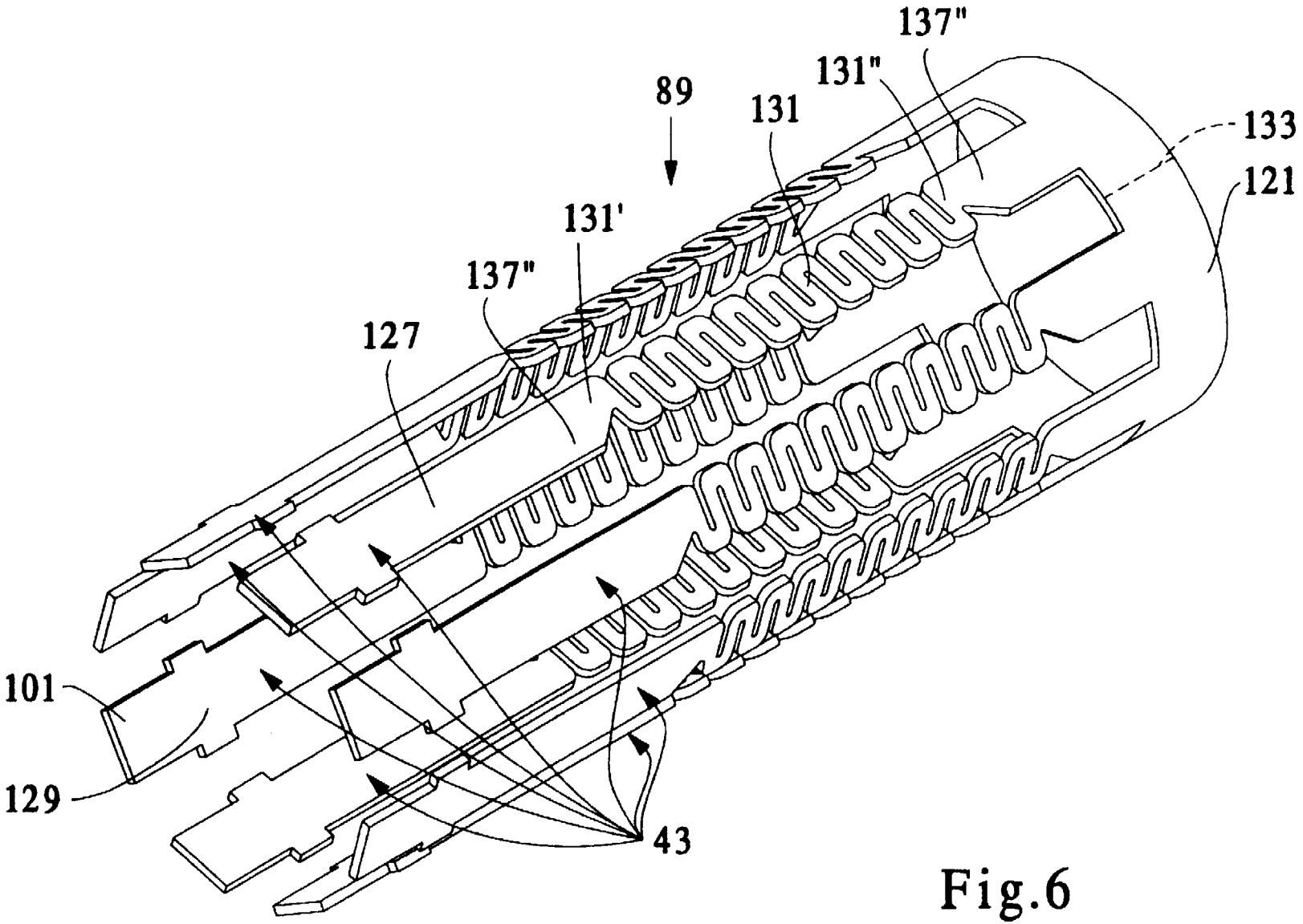
FIG. 6 is a perspective view of a heater assembly according to an embodiment of the present invention.

The heater assembly 89, seen in FIGS. 3A, 5, and 6, is preferably formed from a single, laser-cut sheet of a so-called super-alloy material exhibiting a combination of high mechanical strength and resistance to surface degradation at high temperatures. The sheet is cut or patterned, such as by being stamped or punched or, more preferably, by means of a $CO_2$ laser, to form at least a general outline 115, seen in FIG. 7, of the heater assembly 89.

In the outline 115, the heater elements 43 are attached to one another at their rear ends 101 by a rear portion 117 of the cut sheet outline 115 and, at front ends 119, by a portion that forms a front portion 121 of the heater assembly 89. Two side portions 123 extend between the rear portion 117 and the front portion 121. The rear portion 117 and the side portions 123, while not forming a part of the finished heater assembly 89, facilitate handling of the outline 115 during processing.

After the outline 115 is formed, the heater elements 43 each have a wide portion 125, which, in the finished heater assembly 89, is disposed adjacent the tobacco web 57, and a narrow portion 127 for forming electrical connections with the circuitry 41. If desired, the narrow portion 127 of each heater element 43 is provided with tabs 129 near the rear end 101 to facilitate forming welded connections with the pins 104 or for being fixed in sockets (not shown) for electrical connection with the circuitry 41. The general outline 115 is further processed, preferably by further cutting with a laser, to form a serpentine-shaped "footprint" 131, seen in FIGS. 6 and 8, from the wide portion 125. Of course, if desired, the footprints 131 may be cut at the same time as the general outline 115.

The cut or patterned sheet is preferably electropolished to smooth the edges of the individual heater elements 43. The smoothed edges of the heater elements 43 facilitate insertion of the cigarette 23 in the lighter 25 without snagging. The cut or patterned sheet is rolled around a fixture (not shown) to form a cylindrical shape. The rear portion 117 and the side portions 123 are cut away and edges 133 of the front portion 121 are welded together to form a single piece, or integrated, heater assembly 89, such as is shown in FIG. 6.

The heater assembly 89 may also be made by any one of various other available methods. For example, in accordance with one alternative method, the heater assembly 89 is formed from a sheet that is initially formed into a tube (not shown) and then cut to form a plurality of individual heater elements as in FIG. 6. Further, the heater assembly 89 may be formed from a plurality of discrete heater elements 43 that are attached, such as by spot-welding, to a common ring or band (not shown) serving the same functions, such as serving as an electrical common for the heater elements and providing mechanical support for the heater elements, as the front portion 121. Further still, the forward portion 121 of the heater assembly 89 may be welded or otherwise attached around a sizing ring (not shown) having an inside diameter substantially equal to the cigarette 23. The sizing ring facilitates maintaining the cylindrical heater assembly in a desired shape and offers additional strength.

Figure 9:
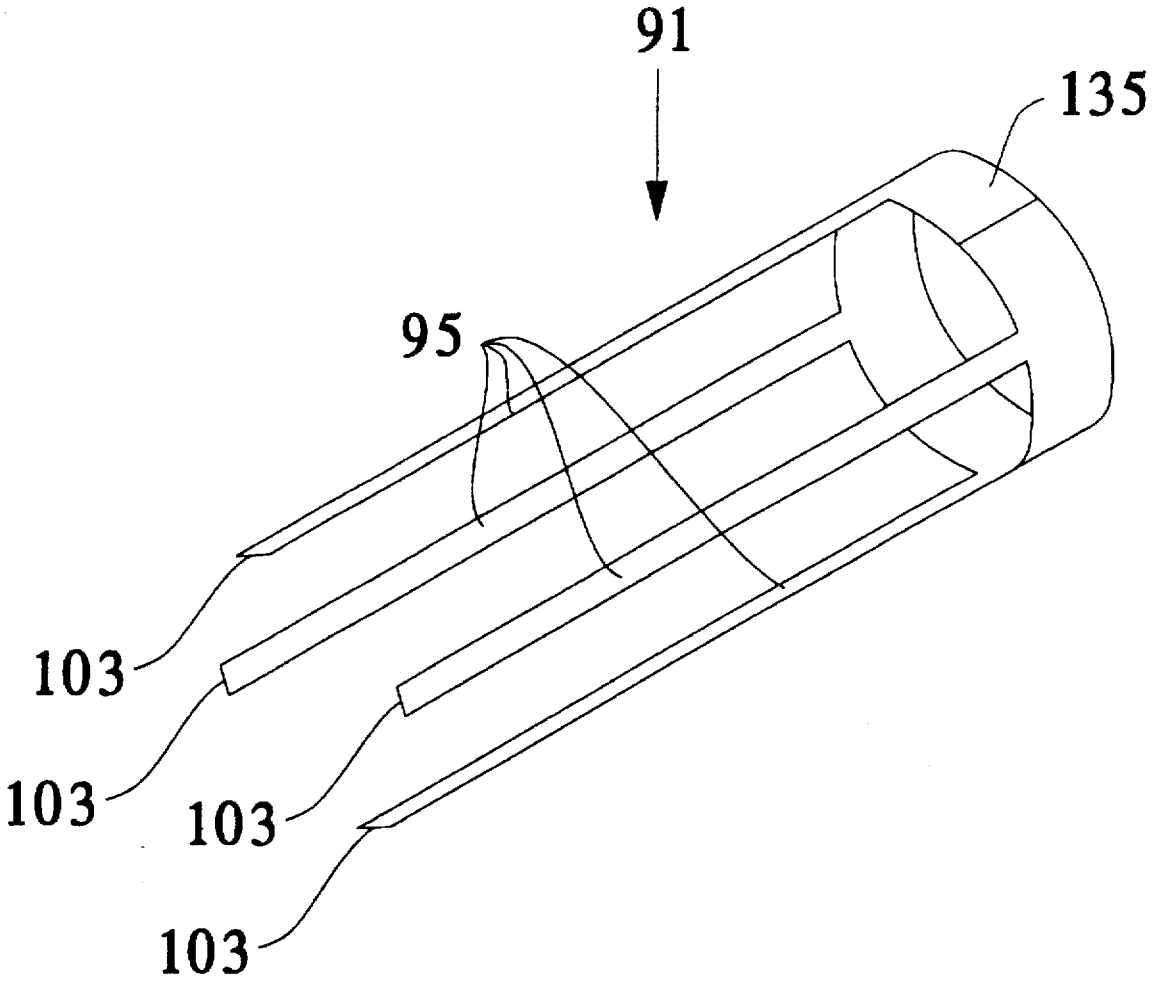
FIG. 9 is a perspective view of a pin assembly according to an embodiment of the present invention.

The pin assembly 91 seen in FIG. 9 is preferably formed by any one of several methods similar to those described above with reference to the heater assembly 89. Like the heater assembly 89, the individual pins 95 and a band-shaped portion for forming a front portion 135 of the pin assembly 91 are also preferably cut from a flat sheet of electrically conductive material, and are rolled and welded to form a cylindrical shape. The pin assembly 91 is preferably formed with an inside diameter substantially equal to the outside diameter of the heater assembly 89. The front portion 121 of the heater assembly 89 is then fitted inside the front portion 135 of the pin assembly 91 and the two portions are secured to one another, preferably by spot welding, such that the four pins 95 are disposed in open spaces between adjacent pairs of heater elements 43. As seen in FIG. 3B, the four pins 95 (only two of which are actually electrically connected to pins 104 extending through the base 50 in the preferred embodiment) are preferably radially disposed at 22.5° angles to adjacent ones of the eight heater elements 43 and their connected pins 104 extending through the base.

The various embodiments of the lighter 25 according to the present invention are all designed to allow delivery of an effective amount of flavored tobacco response to the smoker under standard conditions of use. Particularly, it is presently understood to be desirable to deliver between 5 and 13 mg, preferably between 7 and 10 mg, of aerosol to a smoker for 8 puffs, each puff being a 35 ml puff having a two-second duration. It has been found that, in order to achieve such delivery, the heater elements 43 should be able to reach a temperature of between about 200° C. and about 900° C. when in a thermal transfer relationship with the cigarette 23. Further, the heater elements 43 should preferably consume between about 5 and about 40 Joules of energy, more preferably between about 10 Joules and about 25 Joules, and even more preferably about 15 Joules. Lower energy requirements are enjoyed by heater elements 43 that are bowed inwardly toward the cigarette 23 to improve the thermal transfer relationship.

Heater elements 43 having desired characteristics preferably have an active surface area of between about 3 $mm^2$ and about 25 $mm^2$ and preferably have a resistance of between about 0.5 Ω and about 3.0 Ω. More preferably, the heater elements 43 should have a resistance of between about 0.8 Ω and about 2.1 Ω. Of course, the heater resistance is also dictated by the particular power source 37 that is used to provide the necessary electrical energy to heat the heater elements 43. For example, the above heater element resistances correspond to embodiments where power is supplied by four nickel-cadmium battery cells connected in series with a total non-loaded power source voltage of approximately 4.8 to 5.8 volts. In the alternative, if six or eight such series-connected batteries are used, the heater elements 43 should preferably have a resistance of between about 3 Ω and about 5 Ω or between about 5 Ω and about 7 Ω, respectively.

The materials of which the heater elements 43 are made are preferably chosen to ensure reliable repeated uses of at least 1800 on/off cycles without failure. The heater fixture 39 is preferably disposable separately from the lighter 25 including the power source 37 and the circuitry, which is preferably disposed of after 3600 cycles, or more. The heater element materials are also chosen based on their oxidation resistance and general lack of reactivities to ensure that they do not oxidize or otherwise react with the cigarette 23 at any temperature likely to be encountered. If desired, the heater elements 43 are encapsulated in an inert heat-conducting material such as a suitable ceramic material to further avoid oxidation and reaction.

Based on these criteria, materials for the electric heating means include doped semiconductors (e.g., silicon), carbon, graphite, stainless steel, tantalum, metal ceramic matrices, and metal alloys, such as, for example, nickel-, chromium-, and iron-containing alloys. Suitable metal-ceramic matrices include silicon carbide aluminum and silicon carbide titanium. Oxidation resistant intermetallic compounds, such as aluminides of nickel and aluminides of iron are also suitable.

More preferably, however, the electric heater elements 43 are made from a heat-resistant alloy that exhibits a combination of high mechanical strength and resistance to surface degradation at high temperatures. Preferably, the heater elements 43 are made from a material that exhibits high strength and surface stability at temperatures up to about 80 percent of their melting points. Such alloys include those commonly referred to as super-alloys and are generally based on nickel, iron, or cobalt. Preferably, the super alloy of the heater elements 43 includes aluminum to further improve the heater element's performance (e.g., oxidation resistance). Such a material is available from Haynes International, Inc. of Kokomo, Ind., under the name Haynes® 214™ alloy. This high-temperature material contains, among other elements, about 75% nickel, about 16% chromium, about 4.5% aluminum and about 3% iron by weight.

As noted above, the individual heater elements 43 of the heater assembly 89 preferably include a "footprint" portion 131 having a plurality of interconnected curved regions—substantially S-shaped—to increase the effective resistance of each heater element. The serpentine shape of the footprint 131 of the heater elements 43 provide for increased electrical resistance without having to increase the overall length or decrease the cross-sectional width of the heater element. Heater elements 43 having a resistance in the range from about 0.5 Ω to about 3 Ω and having a foot-print length adapted to fit in the heater fixture 39 of FIG. 3A and the heater fixture 39A of FIG. 5 preferably have N interconnected S-shaped regions, wherein N is in the range from about three to about twelve, preferably, from about six to about ten.

Figure 7:
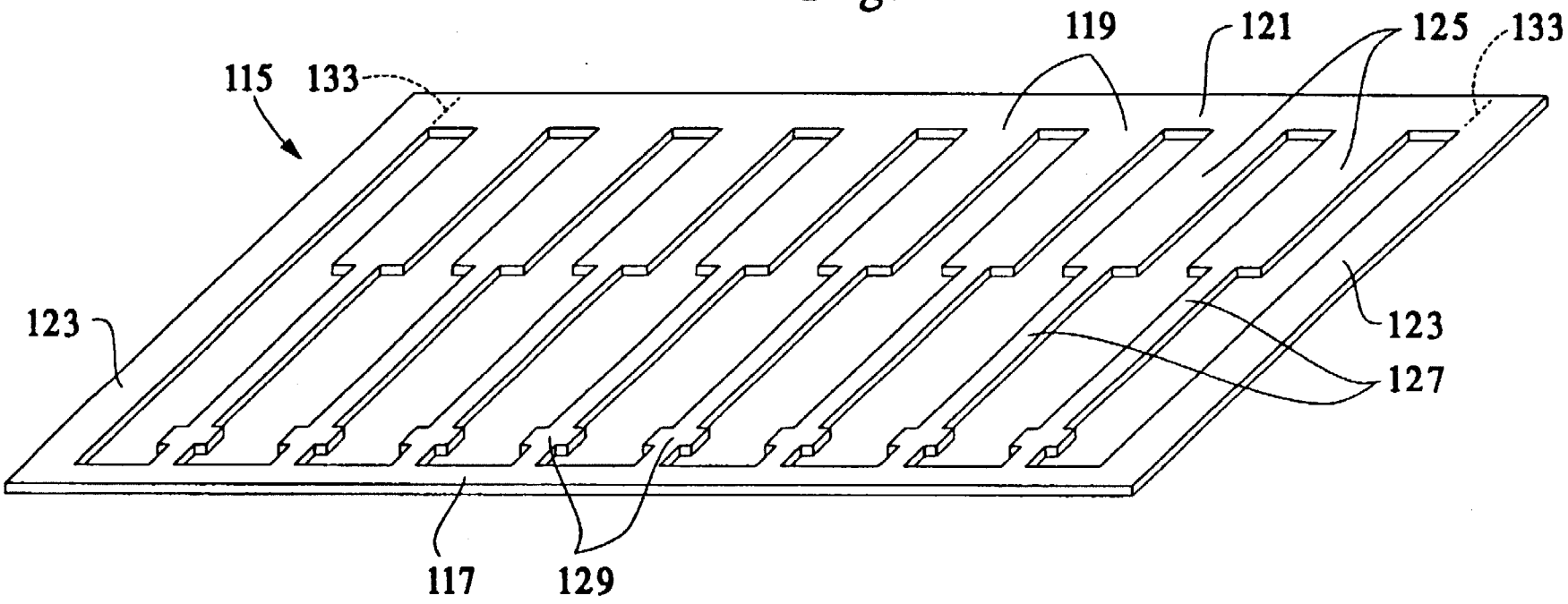
FIG. 7 is an outline of a heater assembly according to an embodiment of the present invention.
Figure 8:
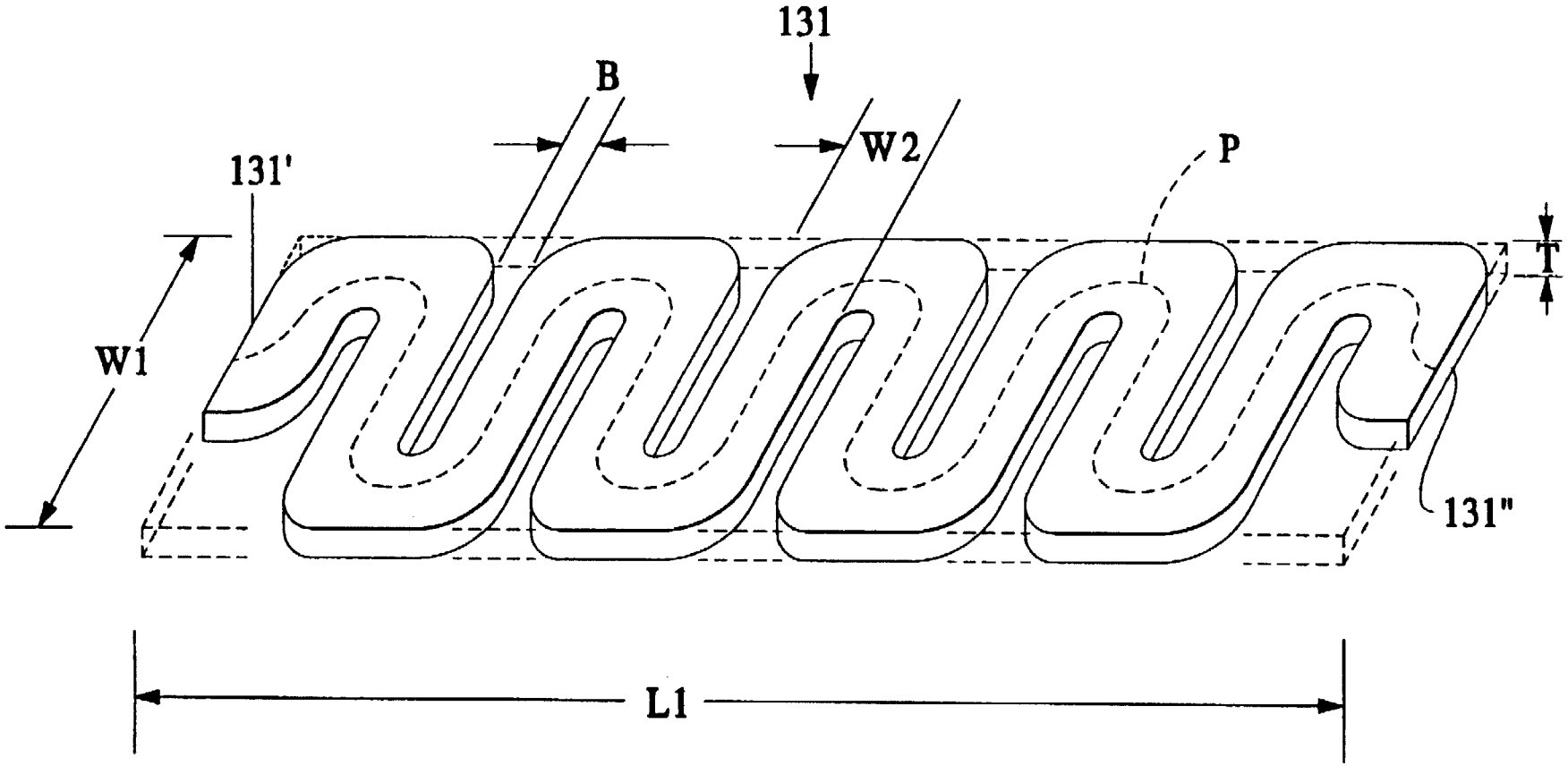
FIG. 8 is a perspective view of a portion of a heater element according to an embodiment of the present invention.

If the heater footprint 131 shown in FIG. 8 is first cut into the shape of the wide portion 125 of FIG. 7, such that the wide portion has a width W1, length L1 and thickness T, the resistance from one end 125' to the opposite end 125" of the wide portion is represented by the equation:

$$R = \frac{\rho \cdot L1}{W1 \cdot T},$$

where ρ is the resistivity of the particular material being used. After forming the footprint 131, the resistance of the footprint is increased since the effective electrical length of the resistance heater element 43 is increased and the cross-sectional area is decreased. For example, after the footprint is formed in the heater element 43, the current path through the heater element is along a path P. The path P has an effective electrical length of approximately 9 or 10•W1 (for the nearly five complete turns of the footprint of the heater element), in contrast to the initial electrical length of L1. Furthermore, the cross-sectional area has decreased from W1•T to W2•T. In accordance with the present invention, both the increase in electrical length and decrease in cross-sectional area have a tendency to increase the overall electrical resistance of the heater element 43, as the electrical resistance is proportional to electrical length and inversely proportional to cross-sectional area.

Thus, forming the footprint 131 in the heater element 43 allows a smaller volume of conducting material to be used to provide a given predetermined resistance over a given heated surface area, e.g. 3 $mm^2$ to 25 $mm^2$. This feature of the present invention provides at least three benefits.

First, for a given resistance, the heater element 43 is formed from a rectangular sheet having a length that, if formed as a linear element, would have to be longer. This allows a more compact heater fixture 39 and lighter 25 to be manufactured at a lower cost.

Second, because the energy required to heat a heater element 43 to a given operating temperature in still air increases as the mass of the heater element increases, the serpentine heater element is energy-efficient in that it provides a given resistance at reduced volumes. For example, if the volume of a heater element 43 is reduced by a factor of two, the mass is also reduced by the same factor. Thus, since the energy required to heat a heater element 43 to a given operating temperature in still air is substantially proportional to the mass and heat capacity of the heater element, reducing the volume by a factor of two also reduces the required energy by two. This results in a more energy-efficient heater element 43.

A third benefit of the reduced volume of the serpentine heater element 43 is related to the time response of the heater element. The time response is defined as the length of time it takes a given heater element 43 to change from a first temperature to a second, higher temperature in response to a given energy input. Because the time response of a heater element 43 is generally substantially proportiona, its mass, it is desirable that a heater element with a reduced volume also have a reduced time response. Thus, the serpentine heater elements 43, in addition to being compact and energy-efficient, are also able to be heated to operating temperatures quicker. This feature of the present invention also results in a more efficient heater element 43.

Thus, by providing a plurality of turns in the heater elements 43 (e.g., in the shape of a serpentine pattern), the resistance of the heater element is increased without the need to increase the length or decrease the cross-sectional area of the heater element. Of course, patterns other than that of the heater element 43 shown in FIG. 8 are available to employ the principles embodied in that configuration and thereby also provide a compact and efficient heater element.

The footprint 131 is cut into the heater elements 43 by any compatible method, preferably by a laser (preferably a $CO_2$ laser). Because of the small geometries used in the serpentine heater elements 43 (for example, gap B in FIG. 8 is preferably on the order of from about 0.1 mm to about 0.25 mm) laser cutting is preferable over other methods for cutting the footprint 131. Because laser energy is adapted to be concentrated into small volumes, laser energy facilitates versatile, fast, accurate and automated processing. Furthermore, laser processing reduces both the induced stress on the material being cut and the extent of heat-affected material (i.e., oxidized material) in comparison to other methods of cutting (e.g., electrical discharge machining). Other compatible methods include electrical discharge machining, precision stamping, chemical etching, and chemical milling processes. It also possible to form the footprint portion 131 with conventional die stamping methods, however, it is understood that die wear makes this alternative less attractive, at least for serpentine designs.

In addition to employing a laser for cutting the serpentine heater elements 43, a laser is preferably also used to efficiently bond together various components of the lighter (preferably an yttrium-aluminum-garnet (YAG) laser). For example, the heater assembly 89 and the pin assembly 91 are preferably spot-welded to one another employing a $CO_2$ or YAG laser. Additionally, the rear ends 101 or the tabs 129 of the heater elements 43 are also preferably laser welded to the electrical terminal pins 104 in the base 50 or to appropriate circuit elements or sockets. Of course, various conventional bonding methods exist for bonding together various components of the lighter.

Potentially damaging thermally induced stresses in the heating elements 43 are minimized in accordance with the present invention. As seen with reference to FIG. 6, the rear end portions 101 (or the tabs 129) which are welded to the pins 104 or other electrical circuitry or components, and the footprint portions 131, which generate heat, are formed as a single-piece heater element 43, thereby avoiding the necessity of welding together separate footprint portions and end portions. Such welding has been observed to produce undesired distortions during heating of heater elements. Longitudinal centerlines of the end portions 101 or tabs 129 are preferably aligned with centerlines of the footprint portions 131. Non-aligned centerlines have also been observed to cause distortions during heating of heater elements. Further, the opposite ends 131' and 131" of the footprints 131 preferably meet with the non-serpentine portions of the heater element 43 in a symmetrical fashion, i.e., each points in the same direction. The symmetry of the ends 131' and 131" tends to prevent the ends of the footprints 131 from twisting in opposite directions during heating and thereby damaging the footprint. The transition areas 137' and 137" at the ends 131' and 131", respectively, of the footprint 131 and between the non-serpentine portions of the heater element 43 and the ends are preferably beveled, as seen in FIG. 6. The beveled transition areas 137' and 137" are also presently understood to reduce thermally induced stresses.

The heater elements 43 and the heater fixture 39 are provided with additional characteristics to avoid other problems associated with heating and repeated heating. For example, it is expected that, during heating, the heater elements 43 tend to expand. As the heater elements 43 are fixed between the positionally fixed front end 135 of the pin assembly 91 attached to the front portion 121 of the heater assembly 89 and the ring 99 near the rear ends 101 of the heater elements, expansion of the heater elements tends to result in either desired inward bending of the heater elements toward the cigarette 23 or undesired outward bending away from the cigarette. Outward bending tends to leave a thermal gap between the heater element 43 and the cigarette 23. This results in inefficient and inconsistent heating of the tobacco web 57 because of the varying degree of interfacial contact between the heater element surfaces and the cigarette.

To avoid outward bowing, the individual heater elements 43 of the heater assembly 89 are preferably shaped to have a desired inward bowing, seen in FIG. 3A. The inward bowing facilitates ensuring a snug fit and good thermal contact between the heater elements 43 and the cigarette 23. The inwardly bowed shape of the heater elements 43 is provided by any desired one of a number of possible methods, such as by shaping a cylindrical heater, such as that shown in FIG. 6, on a fixture (not shown) having the desired inward bow. Preferably, the inwardly bowed shape is formed in the heater elements 43 in a die and press (not shown) prior to shaping the heater assembly 89 into a cylinder. The inwardly bowed shape of the heater elements 43 tends to result in further inward bowing if the heater elements expand during heating. The bowing is preferably fairly gentle over the length of the footprint 131. The beveled transition areas 137' and 137" may be more sharply bent than the more delicate footprint 131. In this manner, it is understood that concentration of thermal stresses at more vulnerable portions of the heater elements 43 is avoided.

If desired, a ring (not shown) is provided around the footprint 131 of the heater elements 43. The ring is understood to serve as a heat sink and, when the footprints 131 of the heater elements 43 expand upon heating, the footprints are caused to expand inwardly, toward the cigarette 23.

Figure 10C:
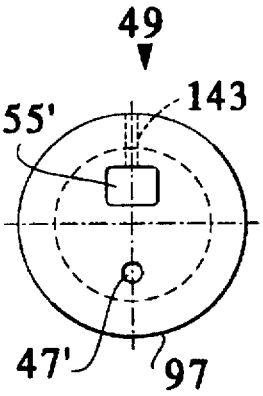
FIG. 10C is a schematic view taken at section 10C—10C of FIG. 10A.
Figure 10A:
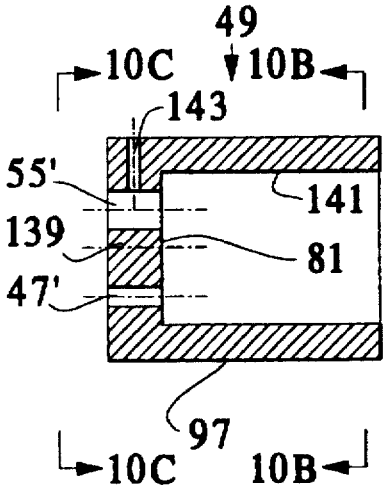
FIG. 10A is a schematic, side cross-sectional view of a spacer according to an embodiment of the present invention.
Figure 10B:
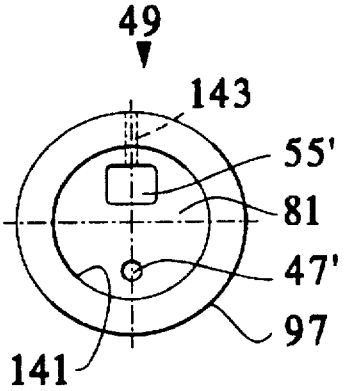
FIG. 10B is a schematic view taken at section 10B—10B of FIG. 10A.

In addition to the above-described heater assembly 89, the heater fixture 39 shown in FIG. 3A also includes the spacer 49 and the heater fixture base 50. The spacer 49, seen alone in FIGS. 10A–10C, has a cylindrical outer surface 97 to which the pins 91 and the heater elements 43 are secured in a friction fit by the ring 99. The spacer 49 further includes a bottom wall 139, the bottom inner surface 81 of which serves to block further movement of the cigarette 23 into the lighter 25 so that the cigarette is properly positioned relative to the heater elements 43, and a cylindrical inner wall 141 to permit passage of the cigarette into the spacer. A portion 47' of the passageway 47 for communication with the puff-actuated sensor 45 is formed in the bottom wall 139. The portion 47' is preferably in the form of a hole or bore extending through the bottom wall 139 parallel to a centerline of the spacer 49. Also, a portion 55' of the opening 55 for the light sensor 53 is formed in the bottom wall 139. A first puff orifice 143 extends from the outer surface 97 of the spacer 49 to the portion 55' of the opening. The first puff orifice 143 facilitates providing a preferred RTD during a first draw on a cigarette 23 by providing an additional passage for air flow from the area surrounding the cigarette to an area adjacent the back-flow filter 63. Because the tobacco web 57 and the overwrap paper 69 tend to restrict air flow into the cigarette 23 until after a heater element 43 has heated an area of the cigarette, the first puff orifice 143 provides air flow to the area of the heater fixture 39 by the back-flow filter 63 of the cigarette. The back-flow filter 63 permits sufficient air flow into the cigarette 23 to provide a lower RTD than would otherwise be experienced. The back-flow filter 63 is, however, preferred to be as "tight" as possible, while still permitting the above-mentioned air flow during the first puff, so that aerosol remaining in the cavity 79 after a draw on the cigarette 23 does not pass back into the lighter 25 through the back-flow filter. After the first puff on the cigarette 23, the area of the tobacco web 57 and the overwrap paper 69 that was heated by the firing of a heater element 43 becomes more air-transmissive. Accordingly, the air flow through the first puff orifice 143 and the back-flow filter becomes insignificant for puffs on the cigarette 23 after the first puff.

Figure 11C:
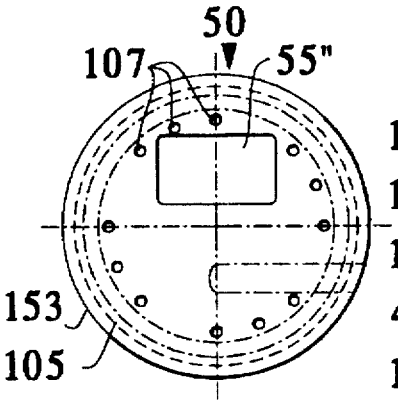
FIG. 11C is a schematic view taken at section 11C—11C of FIG. 11A.
Figure 11A:
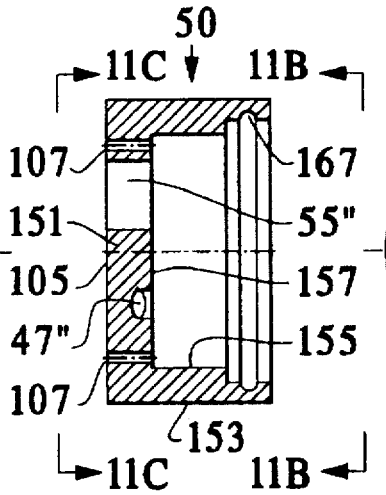
FIG. 11A is a schematic, side cross-sectional view of a base according to an embodiment of the present invention.
Figure 11B:
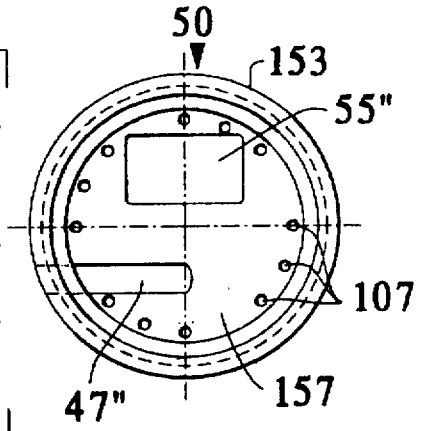
FIG. 11B is a schematic view taken at section 11B—11B of FIG. 11A.

The base 50, seen alone in FIGS. 11A–11C, is substantially cylindrical in shape and includes a bottom wall 151, the pins or leads 104 for connection with the pins 95 and the heater elements 43 extending through the holes 107 formed in the bottom wall and past the bottom outer surface 105 of the base. The base 50 is preferably formed with a cylindrical outer surface 153 and a cylindrical inner wall 155, the inner wall having a diameter larger than the outside diameter of the spacer 49 and substantially equal to the outside diameter of the ring 99. The spacer 49 is preferably held in place relative to the base 50 by a friction fit between an inner wall 169 of the air channel sleeve 87, the ring 99, and the outer surface 97 of the spacer. As discussed further below, means are provided for securing the air channel sleeve 87 to the base 50. The spacer and base 50 may be secured by other or additional means, such as by adhesive, by screws, and by snap-fits. Further, one or more longitudinal ridges and grooves (not shown) may be formed on the spacer and the base 50 to facilitate ensuring a desired angular relationship between the spacer and the base. A portion 47" of the passageway 47 is formed in the bottom wall 151 and preferably extends from near a centerline of the base 50 to a peripheral edge of the base. If desired, the portion 47" is partially in the form of a groove in the bottom inner surface 157 of the base, the groove being made air-tight upon installation of the spacer 49. Preferably, the portion 47" is in the form of intersecting longitudinal and radial bored holes in the bottom wall 151. A portion 55" of the opening 55 is formed in the bottom wall. The portions 47' and 55' of the spacer 49 are aligned with the portions 47" and 55", respectively, of the base 50 to form the passageway 47 and the opening 55.

The member 49A in the embodiment of the heater fixture 39A shown in FIG. 5 is further seen with reference to FIGS. 12A–12D. The member 49A has a cylindrical outer surface 97A to which the pins 95 and the heater elements 43 are secured by the ring 99. The member 49A further includes a bottom wall 139A, the bottom inner surface 81A of which serves to block further movement of the cigarette 23 into the lighter 25 so that the cigarette is properly positioned relative to the heater elements 43 and a cylindrical inner wall 141A of the member to permit passage of the cigarette into the member. A first puff orifice (not shown) may also be provided in the member 49A. The passageway 47A for communication with the puff-actuated sensor 45 is formed in the bottom wall 139A. The passageway 47A is preferably in the form of a hole or bore extending through the bottom wall 139A parallel to a centerline of the member 49A. Also, the opening 55A for the light sensor 53 is formed in the bottom wall 139A. As noted above, rear ends 101 of the heater elements 43 and rear ends 103 of, preferably, at least two of the pins 95 extend past a bottom outer surface 105A of the member 49A for connection to the circuitry 41 and the power source 37. The member 49A is preferably formed with a flanged end 109 in which at least two grooves or holes 107A are formed and through which the rear ends 103 of two of the pins 95 extend past the bottom outer surface 105A. The rear ends 101 of the heater elements 43 are bent to conform to the shape of the flanged end 109 and extend past the bottom outer surface 105A radially outside of an outer edge 111 of the flanged end. The air channel sleeve 87A fits around the outer edge 111 of the flanged end 109 to further secure the ends 101 of the heater elements 43 in position.

Except where otherwise noted, the following discussion of the smoking system 21 refers, for purposes of ease of reference, primarily to components of the heater fixture 39 shown in FIG. 3A–3B. It is, however, understood that the discussion is generally applicable to the embodiment of the heater fixture 39A shown in FIG. 5, as well as to other embodiments not specifically shown or discussed herein. As noted above, the heater fixture can include other devices capable of performing the various functions of the heater fixture, such as providing a space adjacent to heater elements for heating the cigarette.

Figure 13:
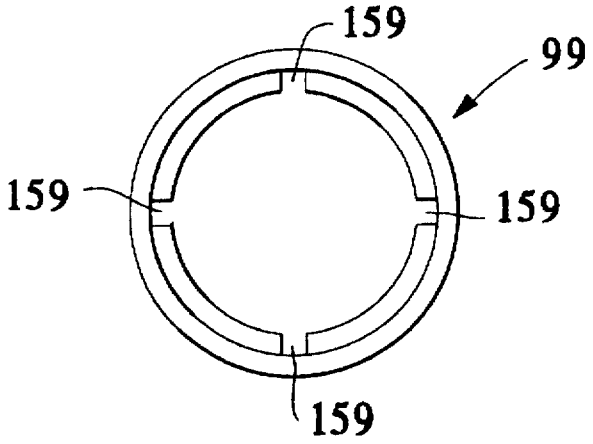
FIG. 13 is an end view of a ring according to an embodiment of the present invention.

An end view of the ring 99 that secures the heater elements 43 and pins 95 around exterior surface 97 of the spacer 49 of FIG. 3A is seen with reference to FIG. 13. The inside diameter of the ring 99 is sufficiently large to permit the ring to surround and secure the heater elements 43 to the cylindrical exterior surface 97 by a friction fit. Longitudinal grooves 159 are formed at 90° angles to one another around the inner periphery of the ring 99 to receive the generally thicker pins 95 so that the ring is adapted to surround and secure the pins to the exterior surface 97.

The air channel sleeve 87 is attached, at a first end 161, to the base 50 and, at a second end 163, to the cap 83. The first end 161 of the air channel sleeve 87 is preferably formed with an external ridge 165 for engaging an internal groove 167 on the inner wall 155 of the base 50. Likewise, the second end 163 of the air channel sleeve 87 is preferably formed with an external ridge 171 for engaging an internal groove 173 on an inner rim 175 of the cap 83. The air channel sleeve 87A of the embodiment of the heater fixture 39A shown in FIG. 5 differs from the embodiment of the air channel sleeve 87 shown in FIG. 3 in that the first end 161A of the air channel sleeve 87A is preferably formed with an internal groove 165A for engaging an external ridge 167A on the outer edge 111 of the flanged end 109 of the member 49A. Portions of the heater elements 43 near the rear ends 101 extend between the engaging portions of the member 49A and the air channel sleeve 87A. As discussed further below with reference to FIG. 17, if desired to increase air flow, one or more radial holes or bores may be provided through portions of the heater fixture 39 such as the air channel sleeve 87, preferably at points along the length of the air channel sleeve where air flow is not blocked or caused to travel through a tortuous path by the cap 83 or the spacer 49 before reaching the cigarette 23.

The cap 83 of the heater fixture 39 seen in FIG. 3A and the cap 83A of the heater fixture 39A seen in FIG. 5 are similar in all respects except that the cap 83 includes a longer inner wall 177 than the inner wall 177A of the cap 83A. The inside diameter of the inner wall 177 of the cap 83 is preferably no larger than the outside diameter of the cigarette 23, and is preferably slightly smaller so that the cigarette is compressed upon insertion in the lighter 25 and held securely in place in an interference fit. The longer inner wall 177 of the cap 39 is preferred and provides added support to the cigarette 23. For purposes of discussion, the cap 83A is shown alone in FIGS. 14A–14D.

Figure 15A:
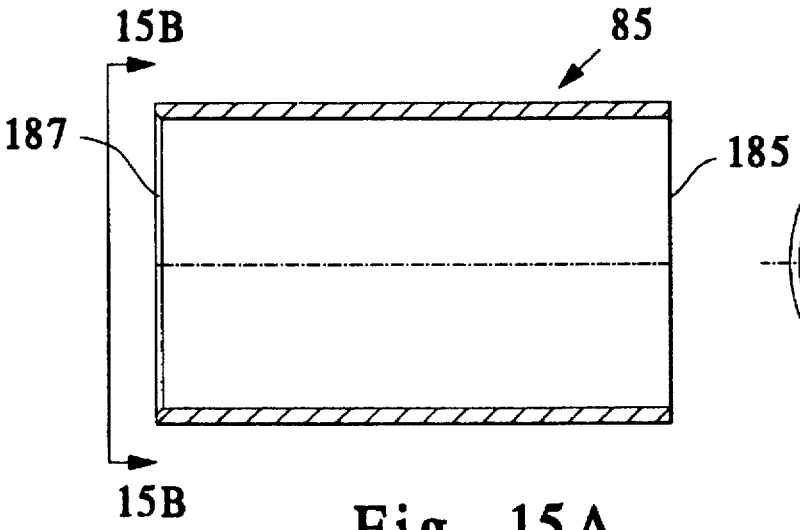
FIG. 15A is a schematic side view of a heater sleeve according to an embodiment of the present invention.
Figure 15B:
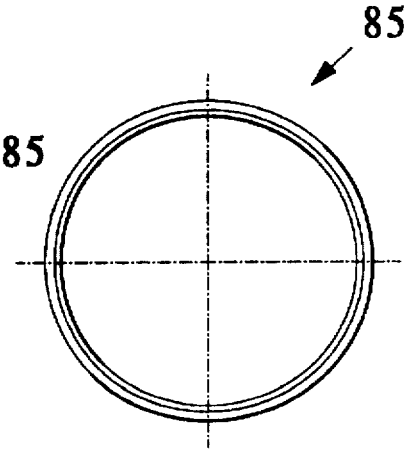
FIG. 15B is an end view taken at section 15B—15B of FIG. 15A.

The cap 83A is formed with a plurality longitudinal holes or passages 179A extending through the cap from the rounded or beveled forward end 93A to a rear face 181A for providing a flow of air into the space in the heater fixture 39A for receiving the cigarette 23, between the cigarette and the air channel sleeve 87 so that a transverse (i.e., radially inward) flow of air passes through the tobacco web 57 by the footprints 131 of the heater elements 43. As seen in FIG. 3A, in the preferred embodiment of the cap 83 of the heater fixture 39, the holes or passages 179 are formed to be larger near the rear face 181 than near the forward end 93 to facilitate obtaining a desired RTD. In another embodiment of the cap, the longitudinal holes or bores are replaced with longitudinal grooves (not shown) that are formed on the inner wall of the cap. With reference to FIGS. 14A–14D, a circumferential groove 183A is formed in the rear face 181A to receive and support the optional protective heater sleeve 85, seen alone in FIGS. 15A–15B. The heater sleeve 85 is a tubular member having first and second ends 185 and 187, either one of which are adapted to be received in the groove 183A. The circumferential groove 183A is formed on a larger radius than the bores or passages 179A to facilitate introduction of air into the heater fixture 39 when a smoker draws on the cigarette 23.

The cap 83, seen in FIG. 3A, may be formed by a molding or a machining process. The cap is preferably formed by molding a single piece cap, such as the cap 83A in FIG. 5. If formed by machining, the cap 83 is preferably formed in two pieces, an outer piece 83' and an inner piece 83", seen in FIG. 3A, that are fitted together. A circumferential recess is formed in the outer surface of the inner piece 83" prior to fitting the inner piece inside the outer piece 83', the recess forming the groove 183 when the inner and outer pieces are attached. The machined two piece cap 83 thereby avoids the necessity of machining a single piece cap to form the groove 183.

The heater sleeve 85 is removed, discarded and replaced with a new heater sleeve by the smoker at any desired smoking interval (e.g., after smoking 30–60 cigarettes 23). The heater sleeve 85 prevents exposing the inner wall 169 of the air channel sleeve 87 to residual aerosol that is generated in the region between the heating elements 43 and the air channel sleeve. Such aerosol is, instead, exposed to the heater sleeve 85.

The heater sleeve 85 is made from a heat-resistant paper- or plastic-like material that is replaced by the smoker after a plurality of cigarettes 23 have been smoked. Thus, in contrast to the "tube-in-tube" construction including an aerosol barrier tube attached to the tobacco flavor unit described in above-incorporated U.S. patent application Ser. No. 07/943,504, which is discarded with the flavor unit after it has been smoked, the heater sleeve 85 of the present smoking system 21 is adapted to be re-used. Accordingly, manufacturing of the cigarette 23 is simplified and the volume of material to be discarded after each cigarette has been smoked is reduced.

Figure 16:
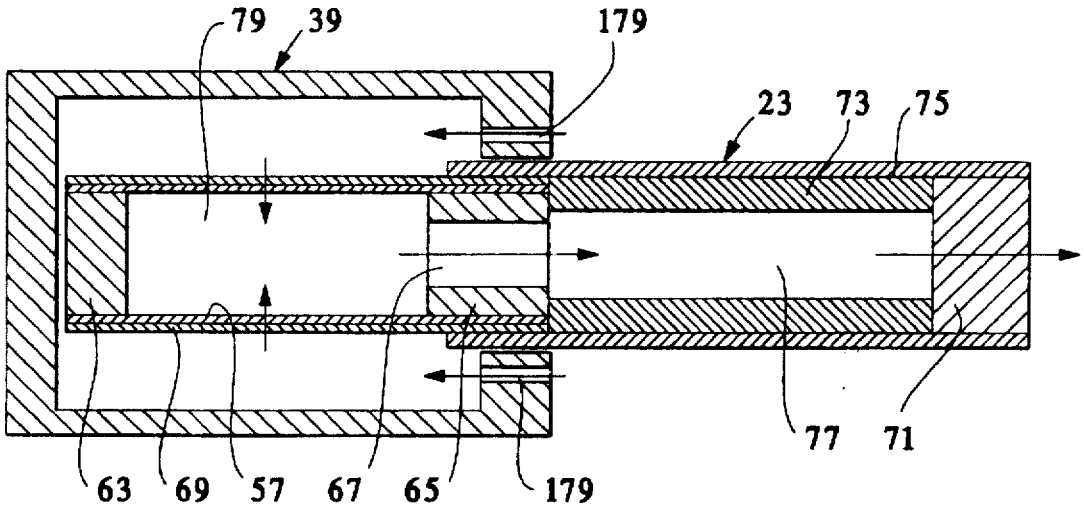
FIGS. 16 and 17 are schematic side cross-sectional views of portions of a smoking system showing air flow paths in the smoking system.

FIG. 16 schematically shows the preferred air flow patterns that are developed in the heater fixture 39 and the cigarette 23 when a smoker draws through the mouthpiece filter 71. Air is drawn, as a result of suction at the mouthpiece filter 71, through the longitudinal bores or passages 179, into the interior of the heater fixture 39 between the air channel sleeve or the heater sleeve (not numbered in this view), past the heater elements (not shown) in contact with the cigarette 23, and through the air permeable outer wrapper 69 and the tobacco web 57 (or through perforations formed therein) and into the cavity 79 in the cigarette. From the cavity 79, the air flows into the longitudinal passage 67 in the first free-flow filter 65, the longitudinal passage 77 in the second free-flow filter 73, and through the mouthpiece filter 71 to the smoker. The quantity and size of the passages 179 are selected to optimize total particulate matter (TPM) delivery to the smoker. In the presently preferred embodiment, six or eight passageways 179 are formed in the cap 83.

Figure 17:
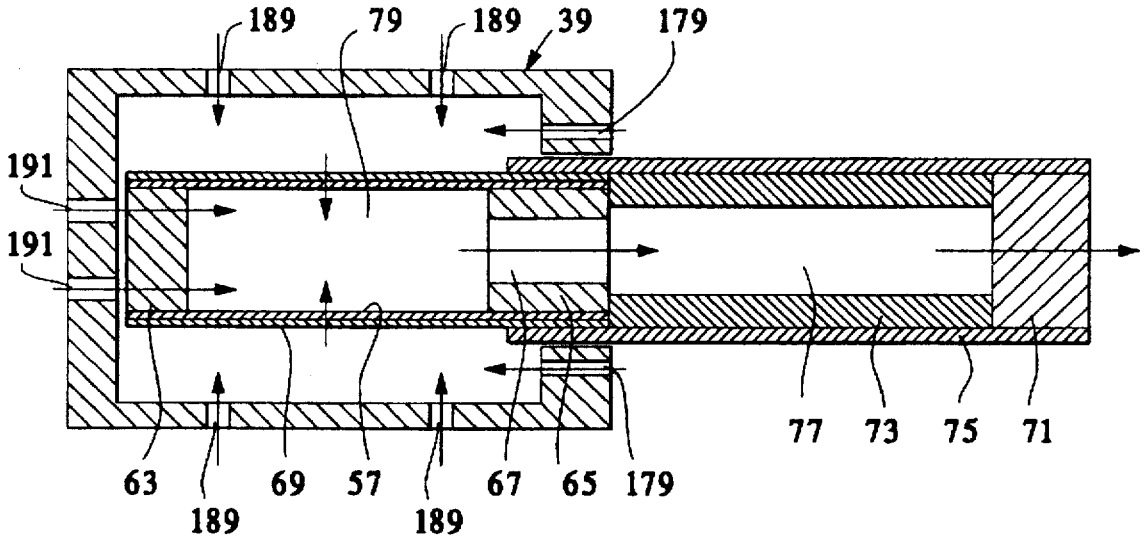

As seen in FIG. 17, if desired, other air passages are provided, instead of or in addition to the passages 179, to permit air to enter the interior of the heater fixture 39 and the cavity 79 of the cigarette 23. For example, one or more radial passages 189 may be formed in the heater fixture 39, at any desired position, usually in the air channel sleeve. Longitudinal passageways 191 may be formed in the heater fixture 39 through the base or the base and the spacer (not shown in the drawing). Also, the passageways 179 in the cap 83 may be in the form of holes or bores, as discussed above, or longitudinal grooves formed in the inner wall 177 of the cap. As discussed above, if desired, a back-flow filter 63 that permits longitudinal flow into the cavity 79 when a smoker draws on the cigarette may be provided.

If desired, the lighter 25 includes an optional sharpened tube (not shown) positioned inside the heater fixture 39 for piercing the back-flow filter 63 of the cigarette 23 upon insertion of the cigarette. The tube is adapted to terminate inside the cavity 79 and provide direct air flow into this cavity when a smoker draws on the cigarette 23. The tube is provided with one or more orifices at a leading end, the orifices preferably being formed in sides of the tube, as opposed to the leading end of the tube, for establishing high-velocity air flow in directions that facilitate swirling of air flow inside the cavity. Such swirling improves mixing of inlet air with the aerosol and vapor generated in the cigarette 23.

Figure 18:
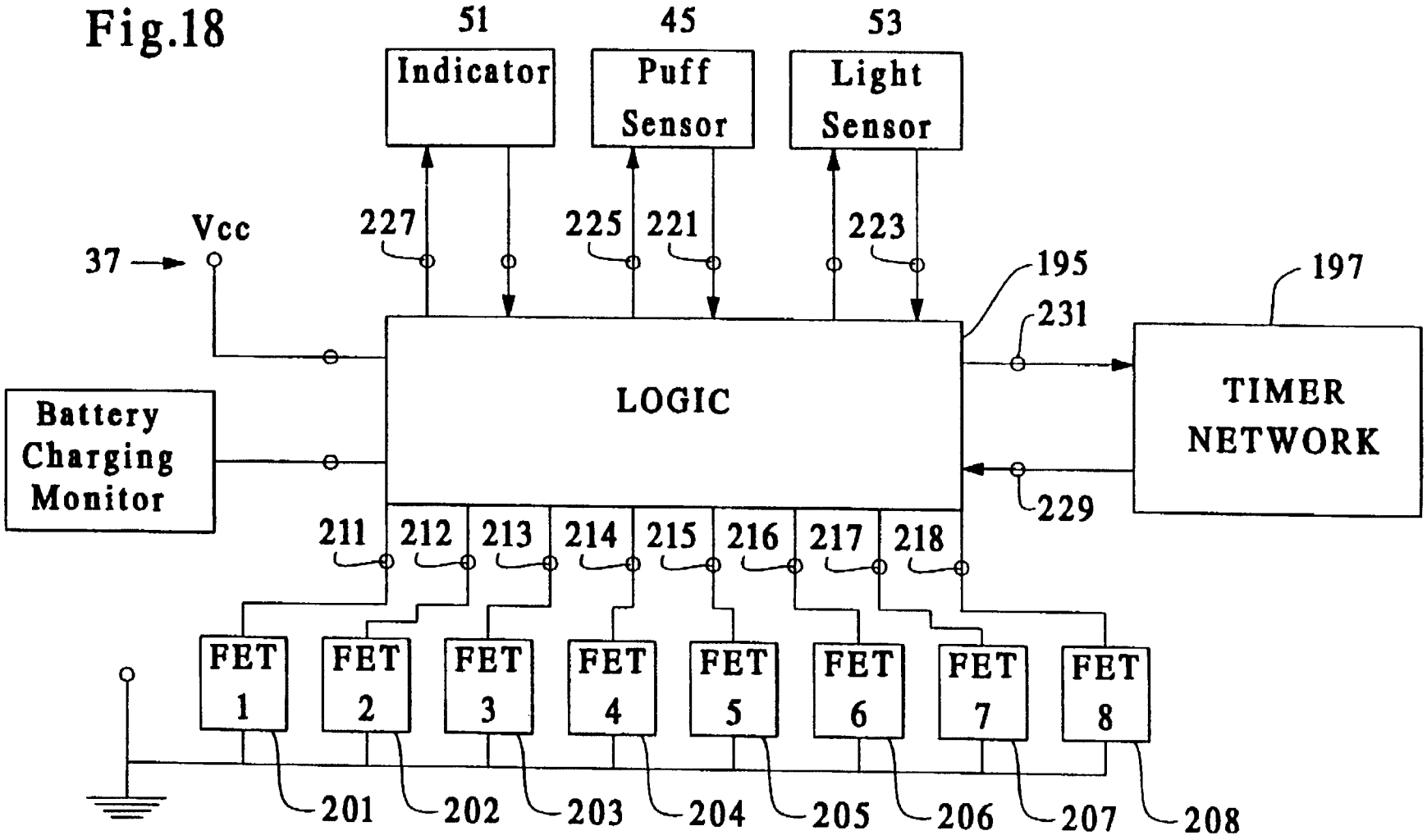
FIG. 18 is a schematic circuit diagram showing circuitry according to an embodiment of the invention.

The electrical control circuitry 41 of the smoking system 21 is shown schematically in FIG. 18. The circuitry 41 includes a logic circuit 195, which is an application specific integrated circuit or ASIC, the puff-actuated sensor 45 for detecting that a smoker is drawing on a cigarette 23, the light sensor 53 for detecting insertion of a cigarette in the lighter 25, the LCD indicator 51 for indicating the number of puffs remaining on a cigarette, a power source 37, and a timing network 197. The logic circuit 195 is any conventional circuit capable of implementing the functions discussed herein. A field-programmable gate array (e.g., a type ACTEL A1010A FPGA PL44C, available from Actel Corporation, Sunnyvale, Calif.) can be programmed to perform the digital logic functions with analog functions performed by other components, while an ASIC is required to perform both analog and digital functions in one component. Features of control circuitry and logic circuitry similar to the control circuit 41 and logic circuit 195 of the present invention are disclosed, for example, in U.S. Pat. No. 5,060,671 and U.S. patent application Ser. No. 07/943,504, the disclosures of which are incorporated by reference.

In the preferred embodiment, eight individual heater elements 43 (not shown in FIG. 18) are connected to a positive terminal of the power source 37 and to ground through corresponding field effect transistor (FET) heater switches 201–208. Individual ones of the heater switches 201–208 will turn on under control of the logic circuit 195 through terminals 211–218, respectively. The logic circuit 195 provides signals for activating and deactivating particular ones of the heater switches 201–208 to activate and deactivate the corresponding ones of the heaters.

The puff-actuated sensor 45 supplies a signal to the logic circuit 195 that is indicative of smoker activation (i.e., a continuous drop in pressure or air flow over a sufficiently sustained period of time). The logic circuit 195 includes debouncing means for distinguishing between minor air pressure variations and more sustained draws on the cigarette to avoid inadvertent activation of heater elements in response to the signal from the puff-actuated sensor 45. The puff-actuated sensor 45 may include a piezoresistive pressure sensor or an optical flap sensor that is used to drive an operational amplifier, the output of which is in turn used to supply a logic signal to the logic circuit 195. Puff-actuated sensors suitable for use in connection with the smoking system include a Model 163PC01D35 silicon sensor, manufactured by the MicroSwitch division of Honeywell, Inc., Freeport, Ill., or a type NPH-5-02.5G NOVA sensor, available from Lucas-Nova, Freemont, Calif., or a type SLP004D sensor, available from SenSym Incorporated, Sunnyvale, Calif.

The cigarette insertion detecting light sensor 53 supplies a signal to the logic circuit 195 that is indicative of insertion of a cigarette 23 in the lighter 25 to a proper depth (i.e., a cigarette is within several millimeters of the light sensor mounted by the spacer 49 and base 50 of the heater fixture 39, as detected by a reflected light beam). A light sensor suitable for use in connection with the smoking system is a Type OPR5005 Light Sensor, manufactured by OPTEK Technology, Inc., 1215 West Crosby Road, Carrollton, Tex. 75006.

In order to conserve energy, it is preferred that the puff-actuated sensor 45 and the light sensor 53 be cycled on and off at low duty cycles (e.g., from about a 2 to 10% duty cycle). For example, it is preferred that the puff actuated sensor 45 be turned on for a 1 millisecond duration every 10 milliseconds. If, for example, the puff actuated sensor 45 detects pressure drop or air flow indicative of a draw on a cigarette during four consecutive pulses (i.e., over a 40 millisecond period), the puff actuated sensor sends a signal through a terminal 221 to the logic circuit 195. The logic circuit 195 then sends a signal through an appropriate one of the terminals 211–218 to turn an appropriate on of the FET heater switches 201–208 ON.

Similarly, the light sensor 53 is preferably turned on for a 1 millisecond duration every 10 milliseconds. If, for example, the light sensor 53 detects four consecutive reflected pulses, indicating the presence of a cigarette 23 in the lighter 25, the light sensor sends a signal through terminal 223 to the logic circuit 195. The logic circuit 195 then sends a signal through terminal 225 to the puff-actuated sensor 45 to turn on the puff-actuated sensor. The logic circuit also sends a signal through terminal 227 to the indicator 51 to turn it on. The above-noted modulation techniques reduce the time average current required by the puff actuated sensor 45 and the light sensor 53, and thus extend the life of the power source 37.

The timing network 197 is preferably a constant Joules energy timer and is used to provide a shut-off signal to the logic circuit 195 at terminal 229, after an individual one of the heater elements that has been activated by turning ON one of the FET heater switches 201–208 has been on for a desired period of time. In accordance with the present invention, the timing network 197 provides a shut-off signal to the logic circuit 195 after a period of time that is measured as a function of the voltage of the power source, which decreases during heating of the heater elements. The timing network 197 is also adapted to prevent actuation of one heater element 43 to the next as the battery discharges. Other timing network circuit configurations may also be used, such as those described in U.S. patent application Ser. No. 07/943,504, the disclosure of which is incorporated by reference.

During operation, a cigarette 23 is inserted in the lighter 25 and the presence of the cigarette is detected by the light sensor 53. The light sensor 53 sends a signal to the logic circuit 195 through terminal 223. The logic circuit 195 ascertains whether the power source 37 is charged or whether there is low voltage. If, after insertion of a cigarette 23 in the lighter 25, the logic circuit 195 detects that the voltage of the power source 37 is low, the indicator 51 blinks and further operation of the lighter will be blocked until the power source is recharged or replaced. Voltage of the power source 37 is also monitored during firing of the heater elements 43 and the firing of the heater elements is interrupted if the voltage drops below a predetermined value.

If the power source 37 is charged and voltage is sufficient, the logic circuit 195 sends a signal through terminal 225 to the puff sensor 45 to determine whether a smoker is drawing on the cigarette 23. At the same time, the logic circuit 195 sends a signal through terminal 227 to the indicator 51 so that the LCD will display the digit "8", reflecting that there are eight puffs available.

When the logic circuit 195 receives a signal through terminal 221 from the puff-actuated sensor 45 that a sustained pressure drop or air flow has been detected, the logic circuit locks out the light sensor 53 during puffing to conserve power. The logic circuit 195 sends a signal through terminal 231 to the timer network 197 to activate the constant Joules energy timer. The logic circuit 195 also determines, by a downcount means, which one of the eight heater elements is due to be heated and sends a signal through an appropriate terminal 211–218 to turn an appropriate one of the FET heater switches 201–208 ON. The appropriate heater stays on while the timer runs.

When the timer network 197 sends a signal through terminal 229 to the logic circuit 195 indicating that the timer has stopped running, the particular ON FET heater switch 211–218 is turned OFF, thereby removing power from the heater element. The logic circuit 195 also downcounts and sends a signal to the indicator 51 through terminal 227 so that the indicator will display that one less puff is remaining (i.e., "7", after the first puff). When the smoker next puffs on the cigarette 23, the logic circuit 195 will turn ON another predetermined one of the FET heater switches 211–218, thereby supplying power to another predetermined one of the heater elements. The process will be repeated until the indicator 51 displays "0", meaning that there are no more puffs remaining on the cigarette 23. When the cigarette 23 is removed from the lighter 25, the light sensor 53 indicates that a cigarette is not present, and the logic circuit 195 is reset.

Other features, such as those described in U.S. patent application Ser. No. 07/943,504, which is incorporated by reference, may be incorporated in the control circuitry 41 instead of or in addition to the features described above. For example, if desired, various disabling features may be provided. One type of disabling feature includes timing circuitry (not shown) to prevent successive puffs from occurring too close together, so that the power source 37 has time to recover. Another disabling feature includes means for disabling the heater elements 43 if an unauthorized product is inserted in the heater fixture 39. For example, the cigarette 23 might be provided with an identifying characteristic that the lighter 25 must recognize before the heating elements 43 are energized.

While this invention has been illustrated and described in accordance with a preferred embodiment, it is recognized that variations and changes may be made therein without departing from the invention as set forth in the claims.

What is claimed is:

1. A method of manufacturing an integrated heater assembly for use in a smoking system for delivering a flavored tobacco response to a smoker, comprising the steps of:

cutting a sheet of resistive material to form a plurality of heater elements connected to one another at at least one end; and forming the sheet into a cylindrical shape;

further comprising the step of shaping the heater elements such that at least a portion of the heater elements are bowed inwardly.

2. The method of claim 1, further comprising the step of smoothing the edges of the heater elements.

3. The method of claim 2, wherein, during the smoothing step, the heater elements are electro-polished.

4. The method of claim 1, wherein the sheet is formed into a cylindrical shape after the sheet is cut to form the plurality of heater elements.

5. The method of claim 1, further comprising the step of welding together edges of a connecting portion that connects the plurality of heater elements.

6. The method of claim 5, wherein, during the welding step, the edges are welded with a laser.

7. The method of claim 6, wherein the laser is a yttrium-aluminum-garnet (YAG) laser.

8. The method of claim 1, wherein, during the cutting step, the sheet of resistive material is cut with a laser.

9. The method of claim 8, wherein the laser is a $CO_2$ laser.

10. The method of claim 1, wherein, during the cutting step, the sheet of resistive material is cut by die stamping.

11. The method of claim 1, wherein, during the cutting step, the sheet of resistive material is cut by precision stamping.

12. The method of claim 1, wherein, during the cutting step, the sheet of resistive material is cut by chemical milling.

13. The method of claim 1, wherein, during the cutting step, the sheet of resistive material is cut by chemical etching.

14. The method of claim 1, wherein the the heater elements are bowed inwardly toward a centerline of the cylindrical shape.

* * * * *